US010105956B2

(12) United States Patent
Kubota et al.

(10) Patent No.: US 10,105,956 B2
(45) Date of Patent: Oct. 23, 2018

(54) LIQUID CONSUMPTION APPARATUS, LIQUID CONSUMPTION SYSTEM

(71) Applicant: SEIKO EPSON CORPORATION, Tokyo (JP)

(72) Inventors: Tomoo Kubota, Nagano (JP); Yasuhiko Kosugi, Nagano (JP); Shinya Yamagata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/371,518

(22) Filed: Dec. 7, 2016

(65) Prior Publication Data

US 2017/0190186 A1 Jul. 6, 2017

(30) Foreign Application Priority Data

Jan. 6, 2016 (JP) ..... 2016-000888
Oct. 14, 2016 (JP) ..... 2016-202309

(51) Int. Cl.
*B41J 2/175* (2006.01)

(52) U.S. Cl.
CPC ..... *B41J 2/17503* (2013.01); *B41J 2/17546* (2013.01); *B41J 2/17566* (2013.01); *B41J 2002/17569* (2013.01)

(58) Field of Classification Search
CPC ..... B41J 2/17503; B41J 2/17546; B41J 2/17566; B41J 2002/17569
See application file for complete search history.

(56) References Cited

U.S. PATENT DOCUMENTS 6,361,138 B1 * 3/2002 Seino ..... B41J 2/16532 347/19
2013/0002752 A1 * 1/2013 Shiraiwa ..... G06Q 30/04 347/19

FOREIGN PATENT DOCUMENTS

JP 2000-198220 A 7/2000

* cited by examiner

*Primary Examiner* — Yaovi M Ameh

(57) ABSTRACT

A printing apparatus 10 calculates an consumed ink amount which is a consumed amount of ink ejected from an ejection unit that ejects ink supplied from an ink cartridge 60, and, in the case where an unused ink cartridge 60 is installed, executes initial maintenance of the ejection unit, determines an initial consumed ink amount which is a consumed amount of liquid consumed by the initial maintenance, writes the consumed ink amount and the initial consumed ink amount to a storage device 70 of the ink cartridge 60 as a consumed ink amount 73 and an initial consumed ink amount 75, and generates and notifies a ratio of the difference between the contained ink amount 71 and the consumed ink amount that is updated relative to the difference between the contained ink amount 71 and the initial consumed ink amount 75 as notification-use information.

4 Claims, 12 Drawing Sheets

| | CONTAINED INK AMOUNT (A) | CONSUMED INK AMOUNT (B) | INITIAL CONSUMED INK AMOUNT (C) | EXISTING EXAMPLE | PRINTING APPARATUS 10 |
|---|---|---|---|---|---|
| Case1 | 100g | 40g | 40g | D1, D11 (A), D12 (B), D13 (A-B) | D2, D21 (A-C), D23 (A-B) |
| Case2 | 100g | 70g | 40g | D3, D31 (A), D32 (B), D33 (A-B) | D4, D31 (A-C), D42 (B-C), D43 (A-B) |

FIG. 5

LIQUID CONSUMPTION APPARATUS, LIQUID CONSUMPTION SYSTEM

Priority is claimed under 35 U.S.C. § 119 to Japanese Applications No. 2016-000888 filed on Jan. 6, 2016 and No. 2016-202309 filed on Oct. 14, 2016 which are hereby incorporated by reference in their entirety.

BACKGROUND

1. Technical Field

The present invention relates to a liquid consumption apparatus, a liquid consumption system.

2. Related Art

When first used after being shipped as a product, a printing apparatus serving as an example of the liquid consumption apparatus executes initial filling processing for filling ink from an ink supply port of an ink cartridge serving as an example of the liquid container into a series of channels (e.g., supply tubes, etc.) for supplying ink serving as the liquid to an ejection head. Also, in order to eliminate mixing of air bubbles into the ink channels when ink cartridges are replaced, mandatory replacement cleaning processing (ink suction and discharge processing) is executed. With the printing apparatus, the amount of ink ejected from the ejection head when such initial filling processing or replacement cleaning processing is executed is calculated by estimation (e.g., JP-A-2000-198220). Also, with the printing apparatus, a function of using the calculated ink amount to calculate a remaining ink amount for notifying to the user and notifying the remaining ink amount to the user is provided.

With the printing apparatus of JP-A-2000-198220, the user is notified using the amount of ink ejected from the ejection head. The amount of ink mandatorily consumed in the printing apparatus is also included in such an ink amount.

However, since the amount of ink mandatorily consumed in the printing apparatus is also included in such a notification of the amount of ink used, it is difficult for the user to grasp the amount of ink consumed in his or her own printing.

Also, in the case where the user checks the remaining ink amount before carrying out his or her own printing, the user could possibly be distrustful of the considerable amount of ink that has been consumed.

SUMMARY

Advantages of some aspects of the invention are realized as the following modes and application examples.

APPLICATION EXAMPLE 1

A liquid consumption apparatus according to this application example is a liquid consumption apparatus configured to have detachably installed therein a liquid container that contains a liquid, the liquid container having attached thereto a storage device configured to store information including an initial contained amount which is an amount of liquid contained in the liquid container that is unused, the liquid consumption apparatus including an ejection unit configured to eject a liquid supplied from the liquid container, a first consumed amount calculation unit configured to calculate a first consumed amount which is a consumed amount of liquid that is ejected from the ejection unit, an initial maintenance execution unit configured to execute initial maintenance of the ejection unit, in a case where the liquid container that is unused is installed, a second consumed amount determination unit configured to determine a second consumed amount which is a consumed amount of liquid consumed by the initial maintenance, a write processing unit configured to write at least the first consumed amount and the second consumed amount to the storage device, an acquisition unit configured to acquire the initial contained amount, the first consumed amount and the second consumed amount from the storage device, and a notification-use information determination unit configured to determine notification-use information which is information for notification, based on the initial contained amount, the first consumed amount and the second consumed amount that were acquired, the notification-use information determination unit calculating a ratio of a difference between the initial contained amount and the first consumed amount relative to a difference between the initial contained amount and the second consumed amount as the notification-use information.

According to this application example, the liquid consumption apparatus calculates and determines a first consumed amount and a second consumed amount that are supplied from a liquid container, and stores the determined consumed amounts in the liquid container. An initial contained amount is also stored in the liquid container. The first consumed amount is the consumed amount of liquid ejected from the ejection unit, and the second consumed amount is the consumed amount of liquid consumed by the initial maintenance. Since the second consumed amount is also a consumed amount of liquid that is ejected from the ejection unit, the first consumed amount includes the second consumed amount. A difference obtained by subtracting the first consumed amount (includes the second consumed amount) from the initial contained amount is the remaining amount that is left in the liquid container. A difference obtained by subtracting the second consumed amount from the initial contained amount is the amount of liquid that is available other than for the initial maintenance, and is, for example, the amount of liquid mainly available for the user to perform printing.

Since the notification information is the ratio of the difference between the initial contained amount and the first consumed amount (includes the second consumed amount) relative to the difference between the initial contained amount and the second consumed amount, the second consumed amount that occurs in the numerator and denominator of the ratio is cancelled out. Accordingly, the notification information is calculated as a ratio of the remaining amount that is left in the liquid container relative to the amount of liquid available other than for the initial maintenance.

That is, the notification information is calculated to be the full remaining liquid amount (100%) immediately after the initial maintenance is executed, and is thereafter calculated as a ratio obtained by deducting the consumed amount of liquid that depends on the amount of printing from the full remaining liquid amount, whenever printing is executed by the user. Accordingly, the user is able to accurately grasp the remaining liquid amount consumed in his or her own printing.

Also, in the case where an unused liquid container is installed in the liquid consumption apparatus, the remaining liquid amount is notified, after execution of the initial maintenance, using the remaining liquid amount immediately after execution of the initial maintenance as the full remaining liquid amount, and thus a situation causing the user to be distrustful is avoided since notification that a considerable amount of liquid has been consumed prior to the user's own printed product being finished as with the existing apparatus is no longer given.

APPLICATION EXAMPLE 2

The liquid consumption apparatus according to the above application example may further include a detection unit configured to detect environmental information including an ambient temperature of the ejection unit, and the first consumed amount calculation unit and the second consumed amount determination unit may calculate the first consumed amount and the second consumed amount with reference to the detected environmental information.

According to this application example, the first consumed amount and the second consumed amount are can be calculated with high accuracy, even if thermal expansion or thermal contraction occurs due to the influence of temperature change.

APPLICATION EXAMPLE 3

The liquid consumption apparatus according to the above application example may further include a display unit, and the display unit may display the notification-use information.

According to this application example, the user can be notified by displaying notification information on a display unit.

APPLICATION EXAMPLE 4

The liquid consumption apparatus according to the above application example may further include a transmission unit configured to transmit information to an information device provided with a notification unit, and the transmission unit may transmit the notification-use information to the information device.

According to this application example, the number of the means for notifying the user can be increased by displaying notification information on the notification unit of another information device.

APPLICATION EXAMPLE 5

A liquid consumption system according to this application example is a liquid consumption system in which a liquid container that contains a liquid is installed in a liquid consumption apparatus that includes an ejection unit configured to eject a liquid, the liquid container including a containing unit configured to contain a liquid for supplying to the liquid consumption apparatus, and a storage device configured to store an initial contained amount which is an amount of liquid contained in the liquid container that is unused, a first consumed amount which is a consumed amount of liquid ejected from the ejection unit in a case where the liquid container is installed in the liquid consumption apparatus, and a second consumed amount which is a consumed amount of liquid consumed in initial maintenance of the ejection unit that is executed in a case where the liquid container that is unused is installed in the liquid consumption apparatus, and the liquid consumption apparatus including an ejection unit configured to eject a liquid supplied from the liquid container, a first consumed amount calculation unit configured to calculate a first consumed amount which is a consumed amount of liquid that is ejected from the ejection unit, an initial maintenance execution unit configured to execute initial maintenance on the ejection unit, in a case where the liquid container that is unused is installed, a second consumed amount determination unit configured to determine a second consumed amount which is a consumed amount of liquid consumed by the initial maintenance, a write processing unit configured to write at least the first consumed amount and the second consumed amount to the storage device, an acquisition unit configured to acquire the initial contained amount, the first consumed amount and the second consumed amount, in a case where the liquid container is installed, and a notification-use information determination unit configured to determine notification-use information which is information for notification, based on the initial contained amount, the first consumed amount and the second consumed amount that were acquired, the notification-use information determination unit calculating a ratio of a difference between the initial contained amount and the first consumed amount relative to a difference between the initial contained amount and the second consumed amount as the notification-use information.

According to this application example, the liquid consumption system calculates and determines a first consumed amount and a second consumed amount that are supplied from a liquid container, and stores the consumed amounts in the liquid container. An initial contained amount is also stored in the liquid container. The first consumed amount is the consumed amount of liquid ejected from the ejection unit, and the second consumed amount is the consumed amount of liquid consumed by the initial maintenance. Since the second consumed amount is also a consumed amount of liquid that is ejected from the ejection unit, the first consumed amount includes the second consumed amount. A difference obtained by subtracting the first consumed amount (includes the second consumed amount) from the initial contained amount is the remaining amount that is left in the liquid container. A difference obtained by subtracting the second consumed amount from the initial contained amount is the amount of liquid that is available other than for the initial maintenance, and is, for example, the amount of liquid that is available mainly for printing carried out by the user.

Since the notification information is the ratio of the difference between the initial contained amount and the first consumed amount (includes the second consumed amount) relative to the difference between the initial contained amount and the second consumed amount, the second consumed amount that occurs in the numerator and denominator of the ratio is cancelled out. Accordingly, the notification information is calculated as a ratio of the remaining amount that is left in the liquid container relative to the amount of liquid available other than for the initial maintenance.

That is, the notification information is calculated to be the full remaining liquid amount (100%) immediately after the initial maintenance is executed, and is thereafter calculated as a ratio obtained by deducting the consumed amount of liquid that depends on the amount of printing from the full remaining liquid amount, whenever printing is executed by the user. Accordingly, the user is able to accurately grasp the remaining liquid amount consumed in his or her own printing.

Also, in the case where an unused liquid container is installed in the liquid consumption apparatus of the liquid consumption system, the full remaining liquid amount is notified after execution of the initial maintenance, and thus a situation causing the user to be distrustful is avoided since notification that a considerable amount of liquid has been consumed prior to the user's own printed product being finished as with the existing apparatus is no longer given.

APPLICATION EXAMPLE 6

A liquid consumption apparatus according to this application example is a liquid consumption apparatus configured to have detachably installed therein a liquid container that contains a liquid, the liquid container having attached thereto a storage device configured to store information relating to the liquid that is contained, the information relating to the liquid including initial amount information indicating an initial contained amount of the liquid in the liquid container that is unused, initial maintenance amount information indicating an initial maintenance amount of the liquid consumed by initial maintenance first executed after the liquid container that is unused is installed in the liquid consumption apparatus, and liquid consumed amount information indicating a consumed amount of the liquid including the initial maintenance amount and consumed by the liquid consumption apparatus out of the liquid contained in the liquid container that is unused, the liquid consumption apparatus including a controller configured to control operations of the liquid consumption apparatus, and a main storage device configured to store information, and the controller storing the initial contained amount, the initial maintenance amount and the consumed amount in the main storage device, based on the initial contained amount information, the initial maintenance amount information and the consumed liquid amount information that are read out from the storage device, reading out the initial contained amount, the initial maintenance amount and the consumed amount from the main storage device, based on a request for remaining amount information indicating a remaining amount of the liquid that is left in the liquid container, and calculating a ratio of a difference between the initial contained amount and the consumed amount relative to a difference between the initial contained amount and the initial maintenance amount as the remaining amount.

With this liquid consumption apparatus, the controller causes a main storage device to store an initial contained amount, an initial maintenance amount and a consumed amount, based on initial contained amount information, initial maintenance amount information and consumed liquid amount information read out from a storage device of the liquid container. Then, based on a request for remaining amount information indicating the remaining amount of liquid that is left in the liquid container, the controller reads out the initial contained amount, the initial maintenance amount and the consumed amount from the main storage device, and calculates the ratio of the difference between the initial contained amount and the consumed amount relative to the difference between the initial contained amount and the initial maintenance amount as the remaining amount. The initial maintenance amount can thereby be excluded in the calculation of the remaining amount.

APPLICATION EXAMPLE 7

In the above liquid consumption apparatus, the main storage device may be an operating memory.

With this liquid consumption apparatus, the initial contained amount, the initial maintenance amount, and the consumed amount can be stored in the operating memory, based on initial contained amount information, initial maintenance amount information and consumed liquid amount information read out from the storage device.

APPLICATION EXAMPLE 8

In the above liquid consumption apparatus, the controller, when it is determined that the liquid container that is installed is unused, may determine to perform execution of the initial maintenance, and update the initial maintenance amount in the main storage device and the initial maintenance amount information in the storage device.

With this liquid consumption apparatus, the initial maintenance amount in the main storage device and the initial maintenance amount information in the storage device are updated when execution of initial maintenance is determined, thus enabling the remaining amount to be calculated, based on the updated initial maintenance amount.

APPLICATION EXAMPLE 9

In the above liquid consumption apparatus, the controller may determine whether execution of the initial maintenance is required, after it is determined that the liquid container that is installed is unused, determine to perform execution of the initial maintenance, when it is determined that execution of the initial maintenance is required, and update the initial maintenance amount in the main storage device and the initial maintenance amount information in the storage device, and maintain the initial maintenance amount in the main storage device and the initial maintenance amount information in the storage device, when it is determined that execution of the initial maintenance is not required.

With this liquid consumption apparatus, the controller, after determining that the installed liquid container is unused, determines whether initial maintenance needs to be executed. Then, the controller, having determined execution of initial maintenance is not required, maintains the initial maintenance amount in the main storage device and the initial maintenance amount information in the storage device. The initial maintenance amount can be saved, when execution of initial maintenance is unnecessary.

APPLICATION EXAMPLE 10

In the above liquid consumption apparatus, the storage device may be configured to store history information indicating existence/non-existence of a use history of the liquid container, and the controller may determine whether execution of the initial maintenance is required, after determining that the liquid container is unused based on the history information read out from the storage device indicating non-existence of the use history, update the history information in the storage device to the history information indicating existence of the use history, after execution of the initial maintenance is completed, when it is determined that execution of the initial maintenance is required, and update the history information in the storage device to the history information indicating existence of the use history, when it is determined that execution of the initial maintenance is not required.

With this liquid consumption apparatus, the controller is able to determine whether the liquid container is unused based on history information read out from the storage device of the installed liquid container.

BRIEF DESCRIPTION OF THE DRAWINGS

The invention will be described with reference to the accompanying drawings, wherein like numbers reference like elements.

FIG. 5 is a diagram illustrating a remaining ink amount display screen.

DESCRIPTION OF EXEMPLARY EMBODIMENTS

Detailed embodiments of the invention will be described below in detail with reference to the drawings. The following are exemplary embodiments of the invention, and are not intended to limit the invention. Note that, in the following diagrams, the various constituent elements may not be shown to scale, in order to facilitate understanding of the description.

First Embodiment

Outline of Printing Apparatus and Printing System

Figure 1:
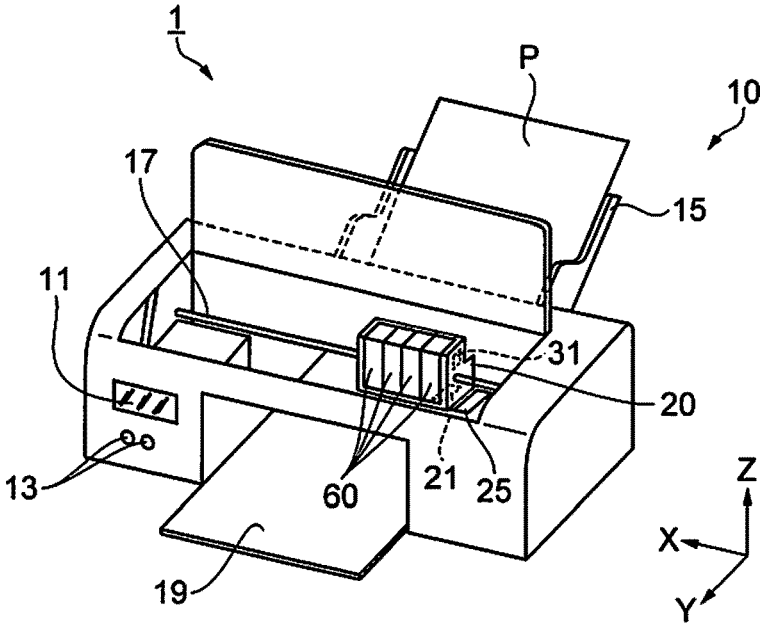
FIG. 1 is a diagram illustrating a schematic configuration of a printing system and a printing apparatus.
Figure 2:
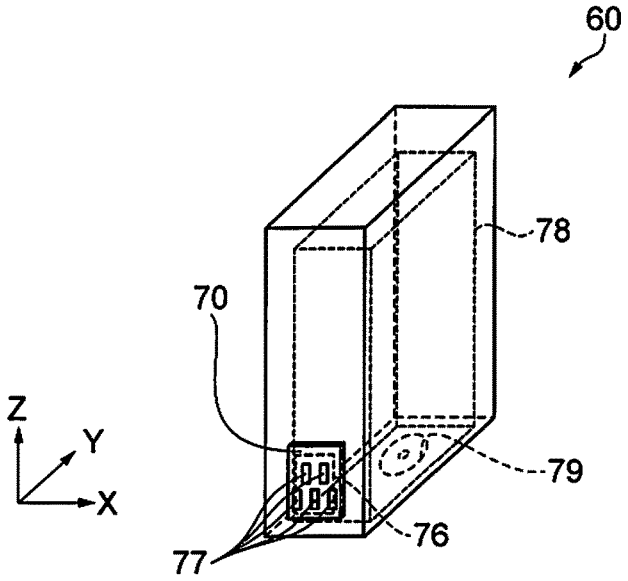
FIG. 2 is a diagram illustrating a schematic configuration of an ink cartridge.

FIG. 1 is a diagram illustrating a schematic configuration of a printing system and a printing apparatus. FIG. 2 is a diagram illustrating a schematic configuration of an ink cartridge. FIG. 1 shows a printing apparatus 10, an ink cartridge 60, and a printing system 1 which is the printing apparatus 10 in which the ink cartridge 60 is installed.

Printing Apparatus

The printing apparatus 10 is an apparatus capable of ejecting ink which is a liquid onto the surface of a medium such as paper P and printing images and the like including characters and graphics. The printing apparatus 10 is constituted by a display unit 11, an operation unit 13, a sheet guide 15, a guide rod 17, a sheet discharge port 19, a carriage 20, an ejection head 21, a home 25, a detection unit 31, and the like.

Note that the printing apparatus 10 corresponds to a liquid consumption apparatus, and the ink cartridge 60 corresponds to a liquid container. Also, the printing system 1 corresponds to a liquid consumption system.

The sheet guide 15 is a guide member that guides the set paper P in the direction of the carriage 20. The paper P, when sent out from the sheet guide 15 by a conveyance roller (illustration thereof is omitted), passes under the carriage 20 (under the bottom surface of the printing apparatus 10), and is conveyed to the sheet discharge port 19 that guides the discharge of the paper P. The direction in which the paper P is conveyed is called the conveyance direction or the Y-axis direction.

The carriage 20 is capable of installing a plurality of (four in FIG. 1) ink cartridges 60 containing ink of respectively different colors, and the ejection head 21 is provided on the underside (surface facing the paper) of the carriage 20. The ejection head 21 is provided with a plurality of rows of nozzles (illustration thereof is omitted) that open in the undersurface facing the paper P that is conveyed, and jets (ejects) ink from the nozzles. The carriage 20 is provided with parts (illustration of all thereof is omitted) such as piercing needles that pierce ink supply ports 79 (discussed later) of the ink cartridges 60, ink chambers into which ink flows after the ink supply port 79 has been pierced, and channels via which the ink flows, and in the case where the ink cartridges 60 are installed, colored ink is ejected from the ejection head 21 via the respective parts. The surface of the paper P is colored by the ejected ink.

Also, the carriage 20 is provided with terminals (illustration thereof is omitted) that are electrically connected to connecting terminals 77 (discussed later) of the ink cartridges 60 in the case where the ink cartridges 60 are installed, and the various data transmitted from a controller 40 is received by a circuit board 76 (discussed later) of the ink cartridges 60 via the terminals of the carriage 20. Also, the ink cartridges 60 are detachable, and the carriage 20 is provided with a installing detection unit (illustration thereof is omitted) that detects that the ink cartridges 60 have been installed, with the signal thereof being transmitted to the controller 40 (discussed later) in the case where the ink cartridges 60 have been installed. The installing detection unit may, for example, be a circuit that detects that the ink cartridges 60 have been installed in the case where the circuit boards 76 of the ink cartridges 60 become accessible via the terminals, or a sensor that optically or physically detects whether the ink cartridges 60 are installed.

The guide rod 17 is a rod that supports the carriage 20, and the carriage 20 reciprocates (scans) along the guide rod 17 in a direction substantially perpendicular to the conveyance direction. Note that the direction in which the carriage 20 scans is called the scanning direction or the X-axis direction. Formation of a planar image or the like on the surface of the paper P is made possible by the carriage 20 that reciprocates in the scanning direction and the paper P that is conveyed in the conveyance direction.

Note that the direction perpendicular to the XY plane including the X-axis direction and the Y-axis direction is called the Z-axis direction.

The home 25 is an apparatus housing the ejection head 21, and is provided with a cap (illustration thereof is omitted) that retains the moisture of the nozzles and a wiper that clean the nozzles, and the like. When an initial cleaning function or the like is executed by the controller 40 (discussed later) of the printing apparatus 10, the carriage 20 is moved to a position at which the ejection head 21 overlaps with the home 25, and processing for cleaning the nozzles of the ejection head 21 is executed. Cleaning processing is processing that involves ejecting ink that is supplied from the ink cartridges 60, and using a wiper to eradicate ink adhering to the surface around the openings in the ejection head 21 and to clean the nozzles. Also, the home 25 may be provided with a waste ink box and a suction pump (illustration thereof is omitted), and processing may be provided for cleaning the nozzles by suctioning ink around the nozzle openings. In the cleaning processing, a considerable amount of ink (e.g., in ink cartridges with a small capacity, about 40% to 60% of the initial contained amount of ink) may be consumed since processing for filling and wiping ink is repeated from the ink cartridges 60 to the ink chambers and channels (illustration of all thereof is omitted) and the ejection head 21.

The detection unit 31 is a sensor that is attached to the carriage 20, and detects the ambient temperature of the ejection head 21 and the ink channels and the temperature of the ink. Information such as detected temperatures are used in the controller 40 (discussed later) when calculating the amount of ink to eject. The detection unit 31 may be installed in the ink chambers or ink channels of the carriage 20. Also, the detection unit 31 may be provided with a plurality of sensors, enabling the ink temperature information to be calculated more accurately using information detected by the plurality of sensors.

The display unit 11 is a display device such as a liquid crystal panel, and the operation unit 13 is an operation apparatus such as an operation button. When instructed by the user via the operation unit 13 to display the remaining ink amount, the respective remaining ink amounts for the ink cartridges 60 of the various colors are displayed on the display unit 11, under the control of the controller 40 (discussed later).

Ink Cartridge

The following shifts to description of FIG. 2.

The ink supply port 79 and a storage device 70 are arranged in the ink cartridge 60 as shown in FIG. 2. Also, a containing unit 78 for containing ink is formed inside the ink cartridge 60. When the ink cartridge 60 is installed in the carriage 20 of the printing apparatus 10, the ink supply port 79 is in communication with the ink chamber of the printing apparatus 10 and supplies ink to the ejection head 21 via the ink channel.

The storage device 70 is provided with the circuit board 76, the connecting terminals 77, and the like. A storage element (illustration thereof is omitted) including a volatile memory and a nonvolatile memory is mounted on the circuit board 76. When the ink cartridge 60 is installed in the carriage 20, the connecting terminals 77 are connected to connecting terminals (illustration thereof is omitted) of the carriage 20, enabling communication of various data between the controller 40 of the printing apparatus 10 and the storage element of the circuit board 76 and the like.

Figure 3:
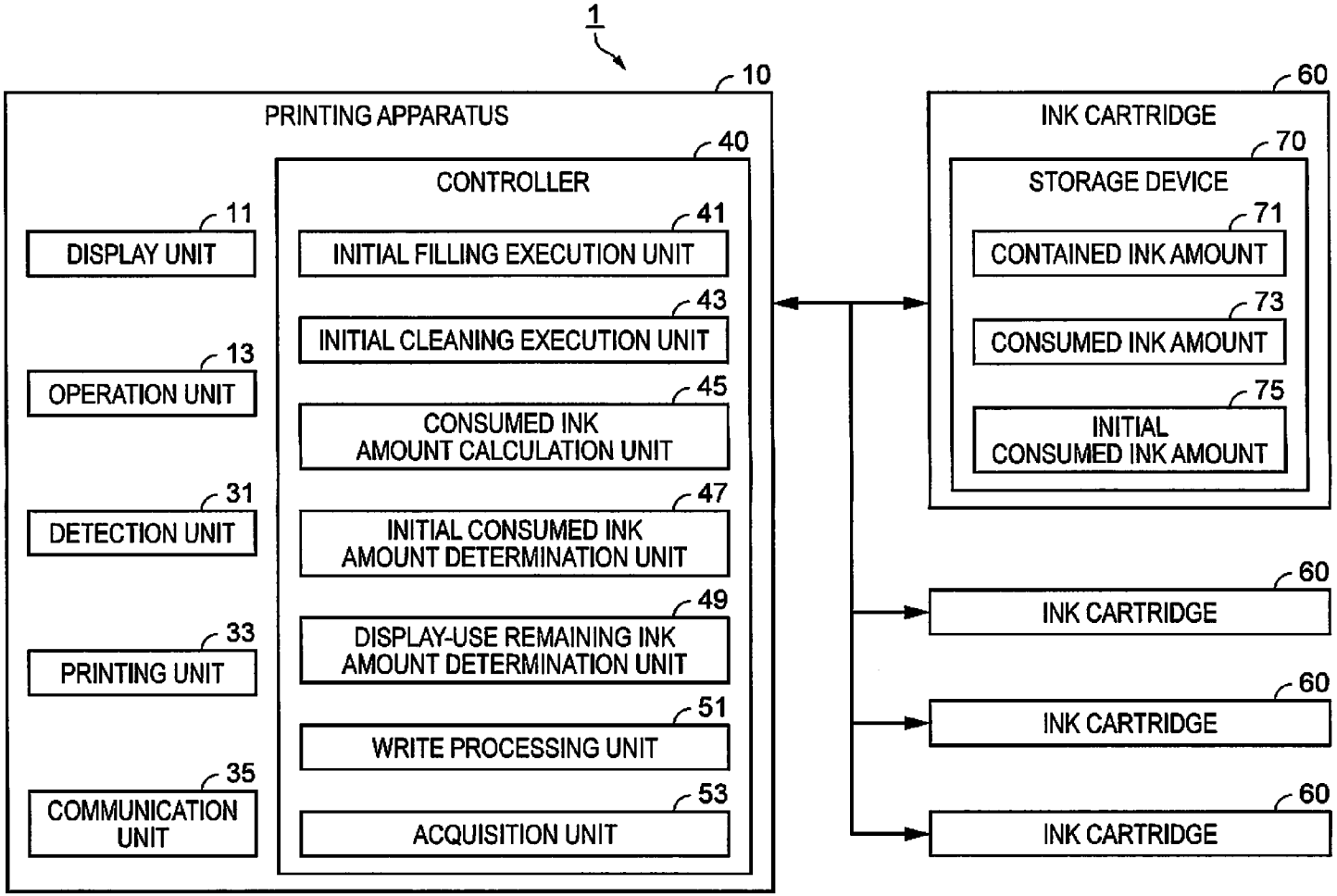
FIG. 3 is a block diagram showing a schematic configuration of a printing system.

The contained amount of ink in the unused ink cartridge 60 is stored in the nonvolatile memory of the circuit board 76 as a contained ink amount 71 (FIG. 3). The amount of ink (weight) injected into the containing unit 78 of the ink cartridge 60 in the manufacturing process of the ink cartridge 60 is written as the contained ink amount 71 in the manufacturing process. The memory area of the contained ink amount 71 is a one time ROM (Read Only Memory) or a mechanism with respect to which updating (writing) is prohibited so as to prevent data that is written from being updated by an external device or by the printing apparatus 10. Note that the contained ink amount 71 corresponds to an initial contained amount.

Also, a consumed ink amount 73 (FIG. 3) and an initial consumed ink amount 75 (FIG. 3) are stored in an updatable memory area in the nonvolatile memory of the circuit board 76. Data on the ink amount calculated in the controller 40 of the printing apparatus 10 is written as the consumed ink amount 73 and the initial consumed ink amount 75. The consumed ink amount 73 and the initial consumed ink amount 75 will be discussed in detail later.

Note that the ink amount and the consumed ink amount are described as weights, but are not limited to being weights and may be any index that enables consumed amounts to be compared. For example, liters or cubic meters may be utilized as units representing the volume (cubage) of the ink amount. In the case where the volume of the ink amount is used, however, calculation and comparison of the various ink amounts is performed on the basis of predetermined environment information (e.g., information on volume in environment of 20° C.) so as to eliminate environmental influences (thermal expansion of the ink amount, etc.) and the like. Also, weight may be replaced with mass. For example, a more accurate comparison is enabled by using mass, which is not affected even in environments that undergo change in altitude, atmospheric pressure or the like, as the ink amount and the consumed ink amount.

Also, the data that is written as the contained ink amount 71 that is contained in the ink cartridge 60, the consumed ink amount 73 and the initial consumed ink amount 75 is stored in the storage area of the nonvolatile memory, and thus is held even when the ink cartridge 60 is removed from the printing apparatus 10.

Schematic Configuration of Printing System

FIG. 3 is a block diagram showing a schematic configuration of the printing system.

The printing system 1 is constituted by the printing apparatus 10 and the ink cartridges 60. A total of four ink cartridges 60 of different ink colors are electrically connected to the controller of the printing apparatus 10, and the cartridges have a common block configuration (description of the configuration of three of the ink cartridges 60 is omitted).

Note that the printing system 1 shown in FIG. 3 is constituted by the printing apparatus 10 and the four ink cartridges 60, but is not limited to a configuration of four cartridges, and may be constituted by five or more ink cartridges or by less than four ink cartridges. Also, a configuration may be adopted in which ink of a plurality of colors is contained in one cartridge, in which case one storage device 70 that manages the ink of a plurality of colors is provided.

Schematic Configuration of Printing Apparatus

The printing apparatus 10 is constituted by the display unit 11, the operation unit 13, the detection unit 31, a printing unit 33, a communication unit 35, the controller 40, and the like.

The display unit 11 is a display apparatus that is configured to have a liquid crystal panel or the like capable of color display, and performs various display processing based on display signals that are output from the controller 40. Information on the respective remaining ink amounts for the ink cartridges 60 of the various colors is displayed with image data or character data on the display unit 11.

The operation unit 13 is an operation button such as a button switch, and an operation signal showing that the button switch has been pressed is output to the controller 40. Note that the operation unit 13 may be a touch panel that covers the liquid crystal panel of the display unit 11.

The detection unit 31 is a sensor that is constituted by a sensor or the like that acquires information relating to the use environment of the printing apparatus 10 as mentioned above, and is, for example, a sensor that detect temperature, humidity or the like. Data on the detected temperature, humidity or the like is output to the controller 40. Environmental information such as temperature and humidity is used in calculating the ink amount that is ejected from the ejection head 21.

The printing unit 33 is constituted by a printer ASIC (Application Specific Integrated Circuit), a printer engine (illustration of all thereof is omitted) and the like. The printer engine also includes printing mechanisms such as the carriage 20, the ejection head 21 and the home 25 that were mentioned above. The printer ASIC is an integrated circuit for controlling the printer engine, and, upon receiving a print instruction from the controller 40, generates print data based on image data, character data and the like that are targeted by the print instruction, and controls the printer engine to output the print data onto the paper P. The printer engine performs printing by ejecting ink from the ejection head 21 onto the paper P. Also, the printer engine performs nozzle cleaning processing and the like, under the control of the controller 40. Note that the ejection head 21 corresponds to an ejection unit.

The communication unit 35 is a USB (Universal Serial Bus) adapter, a Bluetooth (registered trademark) adapter, a wireless LAN (Local Area Network) adapter or the like, is configured to have a common communication protocol with external devices. For example, communication with an external device such as a PC (Personal Computer) or a server is performed using the USB protocol in a USB adapter, the Bluetooth protocol in a Bluetooth adapter, and the IP (Internet Protocol) in a wireless LAN adapter so as to perform reception of original image data to be printed and transmission and reception of various commands and other data. Note that the communication unit 35 corresponds to a transmission unit.

The controller 40 is constituted by an operation processing unit such as a CPU (Central Processing Unit) and storage areas including volatile and nonvolatile memories such as ROM (Read Only Memory), RAM (Random Access Memory), NVRAM (Non-Volatile Random Access Memory), EEPROM (Electrically Erasable Programmable Read Only Memory). Also, the controller 40 may be an ASIC (Application Specific Integrated Circuit) that incorporates these components. The controller 40 performs overall control of units such as the display unit 11, the operation unit 13, the detection unit 31, the printing unit 33, and the communication unit 35 of the printing apparatus 10.

The controller 40 has an initial filling execution unit 41, an initial cleaning execution unit 43, a consumed ink amount calculation unit 45, an initial consumed ink amount determination unit 47, a display-use remaining ink amount determination unit 49, a write processing unit 51, an acquisition unit 53 and the like as functional units. Note that these functional units are examples and not necessarily essential constituent elements, and other functional units may be included.

The initial filling execution unit 41 has a function of implementing initial filling for filling the path (ink chamber, ink channel, etc.) from the ink supply port 79 of the ink cartridge 60 to the ejection head 21 with ink when the printing apparatus 10 is initially started. Also, the initial filling execution unit 41 is started not only when initially starting the printing apparatus 10, but also by the control of the controller 40 in the case where it is determined by the controller 40 that initial filling processing is required. For example, it is determined that initial filling processing is required in cases such as where head cleaning ink was used, in a state where the ink was completely used up last time, and the like.

The initial cleaning execution unit 43 is a functional unit that performs processing for cleaning the ejection head 21, in the case where an unused ink cartridge 60 is installed. Specifically, when it is detected by the installation detection unit of the carriage 20 that an ink cartridge 60 has been installed, the initial cleaning execution unit 43 evaluates whether the ink cartridge 60 is unused. Data on the consumed ink amount 73 and the initial consumed ink amount 75 is acquired from the storage device 70 of the installed ink cartridge 60. If the ink cartridge 60 is in an unused state, both of the acquired data will be "0" indicating that ink has not been used. If the ink cartridge 60 has been used, the consumed amount of ink will have been changed to a numerical value exceeding "0" after being used. The initial cleaning execution unit 43 detects the case where it is determined that the consumed ink amount 73 and the initial consumed ink amount 75 are "0" as an unused ink cartridge 60 having been installed. The initial cleaning execution unit 43, in the case where an unused ink cartridge 60 is installed, controls the printing unit 33 to move the carriage 20 so that the ejection head 21 is positioned at the home 25, repeatedly performs operations such as ejecting ink and driving the wiper, and cleans the nozzle openings of the ejection head 21. Also, the inside of the nozzles may be cleaned by suctioning the nozzle openings of the ejection head 21 with a suction pump or the like provided in the home 25.

Note that the cleaning processing may also be executed when an ink cartridge 60 has been partially used. In the case where it is detected in the controller 40 that an anomaly has occurred in the ability to eject the ink of the ejection head 21 (ink blockage, etc.), cleaning processing may also be performed by an operation to restore the ejection capability. Such cleaning processing is not included in the cleaning processing that is executed by the initial cleaning execution unit 43.

Note that the initial cleaning execution unit 43 corresponds to an initial maintenance execution unit.

The consumed ink amount calculation unit 45 calculates the ink amount that is ejected from the ejection head 21, and outputs information on the calculated ink amount (weight). Specifically, operations in which ink is ejected from the ejection head 21 include processing for printing onto the paper P and flushing processing, in addition to the above-mentioned cleaning processing. Flashing processing involves ejecting ink regardless of the printing from the nozzles of the ejection head 21 during printing onto the paper P.

Ink is ejected as ink droplets from the nozzles, and the volume (large, medium, small, etc.) of the ink droplets and the number of ink droplets that are ejected are strictly managed for each color. Such strict management enables images and the like to be accurately and precisely printed onto the paper P. Similar management is performed not only at the time of print processing but also in cleaning processing and flushing processing, and the volume of ejected ink droplets is accurately calculated. The consumed ink amount calculation unit 45 acquires the temperature of the ink detected by the detection unit 31. Then, using the specific gravity that is unique to each ink material, the weight of the ink is calculated as the ink amount, with consideration for the thermal expansion coefficient.

The consumed ink amount calculation unit 45 also add the ink amounts remaining in the ink chamber, the ink channel and the like within the carriage 20 to the ink amount ejected from the nozzles. Those remaining amounts of ink are calculated with consideration for specific gravity and the thermal expansion coefficient, using the cubage of the ink chamber, ink channel and the like that is stored in the storage area of the controller 40 in advance and the information on ink temperature detected by the detection unit 31.

The calculated ink amount is written to the storage device 70 as the consumed ink amount 73, via the write processing unit 51. The consumed ink amount calculation unit 45 writes the calculated ink amount every reciprocation in the scanning direction in the case of print processing, and immediately after the end of processing in the case of flushing processing and cleaning processing. Also, the ink amount calculated by the consumed ink amount calculation unit 45 is also output to the initial consumed ink amount determination unit 47.

Note that the consumed ink amount calculation unit 45 corresponds to a first consumed amount calculation unit, and the ink amount calculated by the consumed ink amount calculation unit 45 corresponds to a first consumed amount.

The initial consumed ink amount determination unit 47 determines the amount of ink consumed from when an unused ink cartridge 60 is installed until when printing is first performed. Specifically, installation of an unused ink cartridge 60 is detected (by a similar detection method to the initial cleaning execution unit 43), and thereafter the output result (ink amount) of the consumed ink amount calculation unit 45 is added. At the point at which the processing by the initial cleaning execution unit 43 ends and a print-ready state is entered, the accumulated ink amount is stored in the storage device 70 via the write processing unit 51 as the initial consumed ink amount 75.

Note that the initial consumed ink amount determination unit 47 corresponds to a second consumed amount determination unit, and the ink amount that is determined by the initial consumed ink amount determination unit 47 corresponds to a second consumed amount.

The display-use remaining ink amount determination unit 49 generates information on a display-use remaining ink amounting on the display unit 11. To be more precise, the contained ink amount 71, the consumed ink amount 73 and the initial consumed ink amount 75 are acquired from the storage device 70 of the ink cartridge 60 of each color, and a display-use remaining ink amount is determined based on an equation (1) shown below.

Here, the contained ink amount 71 is given as an ink amount (A) and the initial consumed ink amount 75 is given as an ink amount (C). Also, an ink amount obtained by adding the ink amount further calculated by the consumed ink amount calculation unit 45 after the ink cartridge 60 has been installed to the ink amount of the consumed ink amount 73 is given as an ink amount (B). The calculated display-use remaining ink amount is then given as an remaining ink amount (X).

$$X=(A-B)/(A-C) \quad (1)$$

The ink amounts (A), (B) and (C) are in units of grams indicating weight, and the remaining ink amount (X) is a ratio. That is, the remaining ink amount (X) of the display-use remaining ink amount is a ratio with the difference between the contained ink amount 71 and the initial consumed ink amount 75 as the denominator and the difference between the contained ink amount 71 and the consumed ink amount 73 as the numerator. The ratio, as a preferred example, is represented with a percentage, and is calculated with a ratio in the case the denominator is taken as 100% as the remaining ink amount (X) %.

Note that due to the initial consumed ink amount determination unit 47, the ink amount (C) is part of the weight of the ink amount (B), and thus the ink amount (B) includes the ink amount (C). A difference obtained by subtracting the ink amount (C) from the ink amount (B) is the consumed ink amount other than the initial consumed ink amount, and is equivalent to an ink amount obtained by the user implementing print processing or flushing processing or implementing cleaning processing that excludes initial cleaning processing.

Note that the display-use remaining ink amount determination unit 49 corresponds to a notification-use information determination unit, and the display-use remaining ink amount corresponds to information for notification. Also, the ink amount (A) in equation (1) corresponds to an initial contained amount, the ink amount (B) corresponds to a first consumed amount, the ink amount (C) corresponds to a second consumed amount, and the right-hand side of equation (1) corresponds to a ratio of difference between the initial contained amount and the first consumed amount relative to the difference between the initial contained amount and the second consumed amount.

The write processing unit 51 establishes communication with the storage device 70 of the ink cartridge 60, and writes data generated by the controller 40 to the storage device 70. Specifically, the write processing unit 51 establishes bus communication with the storage device 70, and enables data transmission. Thereafter, the ink amount output from the consumed ink amount calculation unit 45 is stored as the consumed ink amount 73 of the storage device 70. The ink amount output from the initial consumed ink amount determination unit 47 is stored in the initial consumed ink amount 75 of the storage device 70.

The acquisition unit 53 establishes communication with the storage device 70 of the ink cartridge 60, and reads and acquires data that is stored in the storage device 70. The acquired data is output to the display-use remaining ink amount determination unit 49.

Note that the write processing unit 51 and the acquisition unit 53 may be constituted as the same functional unit that performs the writing to and reading from the storage device 70. Also, communication with the ink cartridge 60 is not limited to bus communication, and may be serial communication or another communication system.

The ink cartridge 60 is constituted by the storage device 70 and the like as above-mentioned, and the contained ink amount 71, the consumed ink amount 73 and the initial consumed ink amount 75 are stored in the area of the nonvolatile memory. The contained ink amount 71 cannot be updated once written in the manufacturing process. The contents of the consumed ink amount 73 and the initial consumed ink amount 75 are updatable by the printing apparatus 10.

Flowchart of Remaining Ink Amount Display Method

Figure 4:
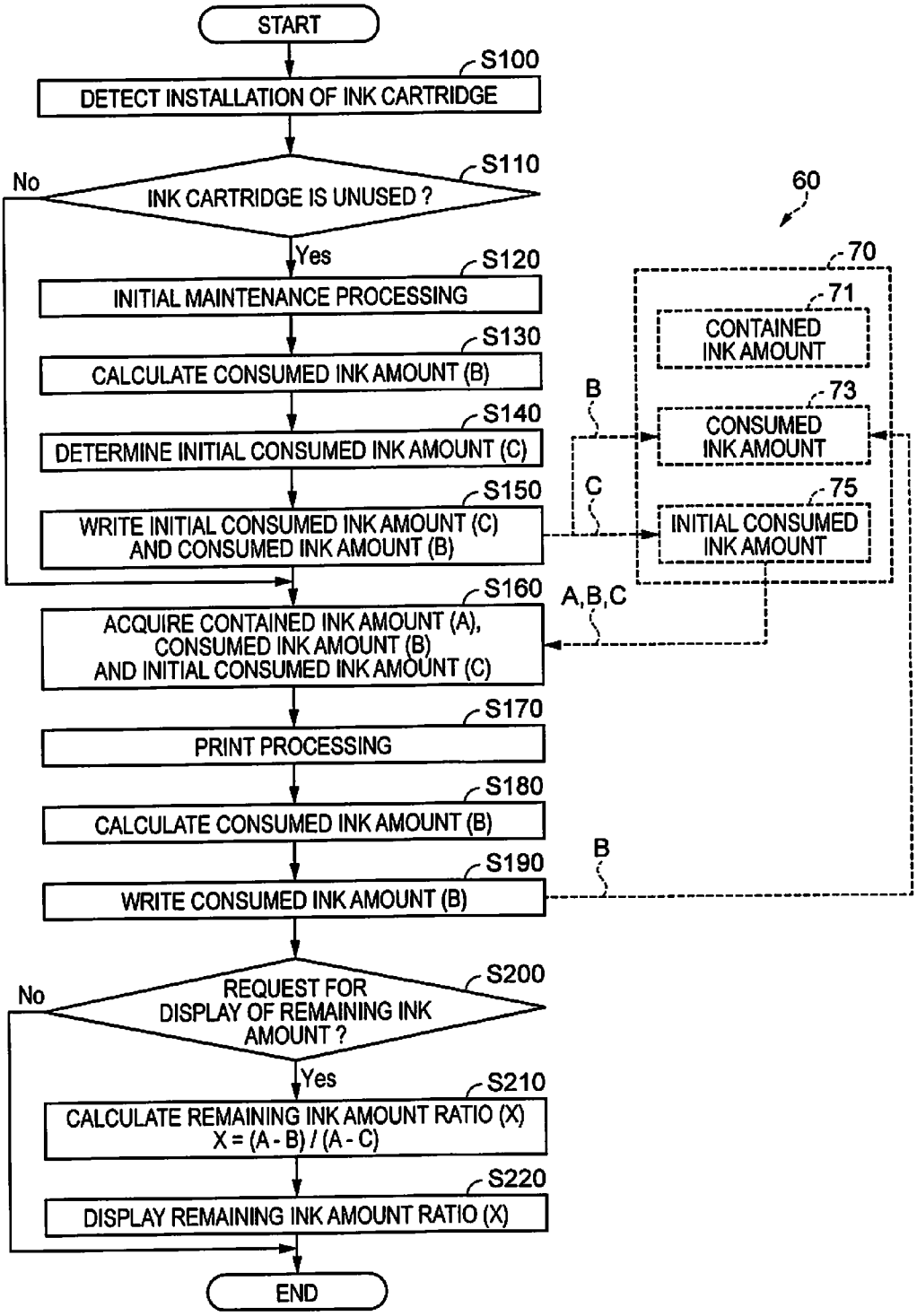
FIG. 4 is a flowchart of a remaining ink amount display method.

FIG. 4 is a flowchart of the remaining ink amount display method. This flowchart is a flow of processing that is executed as a result of the controller 40 controlling respective units including the display unit 11, the operation unit 13, the detection unit 31 and the printing unit 33. Note that this flowchart corresponds to a liquid consumption method.

In step S100, detection of installation of the ink cartridge 60 is performed. If an ink cartridge 60 is installed, the processing proceeds to step S110.

In step S110, it is determined whether the ink cartridge 60 is unused. Specifically, communication is established with the storage device 70 of the installed ink cartridge 60, and data on the consumed ink amount 73 and the initial consumed ink amount 75 is acquired. If both data are "0", it is determined that the ink cartridge 60 is unused (Yes), and the processing advances to step S120. If either data is not "0", it is determined that the ink cartridge 60 is used (No), and the processing advances to step S160.

In step S120, initial maintenance processing is executed. Specifically, processing for cleaning the ejection head 21 is performed. Also, at this time, initial filling processing is also performed if needed. Note that this step corresponds to an initial maintenance execution step.

In step S130, the consumed ink amount is calculated. Specifically, the volume of ink droplets that are ejected from the ejection head 21 is added. The thermal expansion coefficient of the ink material corresponding to the ink temperature acquired from the detection unit 31 is applied to the volume of the ink droplets and the weight is calculated. The calculated weight is the consumed ink amount, and corresponds to the ink amount (B) in the above-mentioned equation (1). Note that this step corresponds to a first consumed amount calculation step, and the ink amount (B) corresponds to a first consumed amount.

In step S140, an initial consumed ink amount is determined. The consumed ink amount calculated in step S130 is the consumed ink amount after the initial maintenance processing in the unused ink cartridge 60, and is thus the initial consumed ink amount. Accordingly, in this step, the weight of the ink amount (B) calculated in step S130 is determined as the initial consumed ink amount. The initial consumed ink amount corresponds to the ink amount (C) in the above-mentioned equation (1).

Note that this step corresponds to a second consumed amount determination step, and the ink amount (C) corresponds to a second consumed amount.

In step S150, the initial consumed ink amount and the consumed ink amount are written. Specifically, communication is established with the storage device 70 of the ink cartridge 60, and a writable state is entered. The contents of the ink amount (C) and the ink amount (B) calculated at steps S130 and S140 are written as the initial consumed ink amount 75 and the consumed ink amount 73 of the storage device 70. Note that this step corresponds to a write processing step.

In step S160, the contained ink amount, the consumed ink amount and the initial consumed ink amount are acquired. Specifically, communication is established with the storage device 70 of the ink cartridge 60, and the contained ink amount, the consumed ink amount and the initial consumed ink amount are acquired. This step is processed in cases such as where an ink cartridge 60 that is not unused is installed in step S100, or where the power supply of the printing apparatus 10 is turned on in a state where an ink cartridge 60 that is partially used is installed. With regard to the above-mentioned equation (1), the contained ink amount corresponds to the ink amount (A), the consumed ink amount corresponds to the ink amount (B), and the initial consumed ink amount corresponds to the ink amount (C). Note that this step corresponds to an acquisition step.

In step S170, print processing is performed.

In step S180, the consumed ink amount is calculated. Specifically, the volume of ink droplets of the ink that is ejected from the ejection head 21 by the print processing, flushing processing during printing and the like is added. The thermal expansion coefficient of the ink material corresponding to the ink temperature acquired from the detection unit 31 is applied to the volume of ink droplets and the weight is calculated. The calculated weight is the consumed ink amount consumed in the print processing. The weight of the calculated consumed ink amount is added to the ink amount (B) acquired at step S160, and the ink amount (B) is updated. Note that this step corresponds to a first consumed amount calculation step together with step S130.

In step S190, the consumed ink amount is written. Specifically, communication is established with the storage device 70 of the ink cartridge 60, and a writable state is entered. The consumed ink amount (contents of the ink amount (B)) calculated at step S180 is written (overwritten) as the consumed ink amount 73 of the storage device 70. Note that this step corresponds to a write processing step together with step S150.

In step S200, it is determined whether there is a request to display the remaining ink amount. Specifically, in the case where a menu or the like displaying the remaining ink amount is selected by operation of the display unit 11 and the operation unit 13 under the control of the controller 40 is selected, it is determined that there is a request to display the remaining ink amount. If there is a request to display the remaining ink amount, the processing advances to step S210, and if there is not a display request, the processing advances to the end (No).

In step S210, the remaining ink amount ratio is calculated. Specifically, the ink amount (B) in which the consumed ink amount calculated in step S180 is stored, the ink amount (A), which is the contained ink amount acquired in step S160, and the ink amount (C), which is the initial consumed ink amount, are applied to equation (1), and the remaining ink amount (X) is calculated. Note that the ratio of the remaining ink amount (X) may be a numerical value increased 100 fold in order to display the remaining ink amount with the numerical value as a percentage. Note that this step corresponds to a notification-use information determination step, and the remaining ink amount (X) corresponds to notification-use information.

In step S220, the remaining ink amount ratio is displayed. Specifically, screen data to be displayed on the display unit 11 is generated, based on the value of the remaining ink amount (X) of the remaining ink amount ratio calculated in step S210. Screen data is created as image data showing a ratio of the remaining ink amount for each color of the ink cartridges 60. The image data represents an image in which ink of the color of the ink cartridge 60 remains at a ratio of X % of the numerator (A−B) shown in equation (1) relative to 100%, where the denominator (A−C) shown in equation (1) is taken as 100%.

The end is shown after step S220, but in the case where the print processing is continued, the processing returns to step S170 and similar processing is repeatedly performed.

Also, in the above-mentioned step S190, the calculated ink amount (B) is written as the consumed ink amount 73 of the storage device 70 whenever print processing is performed, and thus even in the case where the ink cartridge 60 is uninstalled from the printing apparatus 10, the most recent consumed ink amount is stored as the consumed ink amount 73.

Note that the processing in steps S200 to S220 and beyond need not necessarily be executed after the print processing of step S170, and are steps that are executed when there is a request for remaining ink amount display from the user.

Comparison of Display Screens

FIG. 5 is a diagram illustrating a remaining ink amount display screen. The table shown in FIG. 5 shows images of display screens that are displayed on the display unit 11 of the printing apparatus 10. Furthermore, display screens of a existing example and the printing apparatus 10 in the case where the weights of the contained ink amount, the consumed ink amount and the initial consumed ink amount are placed under the same conditions are compared.

Case 1 shows a state in which an unused existing ink cartridge and an unused ink cartridge 60 are respectively installed in a existing apparatus and the printing apparatus 10, and print processing has not yet been performed. The contained ink amount, the consumed ink amount and the initial consumed ink amount are respectively given as (A)=100 g (g stands for grams), (B)=40 g and (C)=40 g, and the weight of the consumed ink amount (B) has all been consumed as the initial consumed ink amount (C).

A display screen D1 is an exemplary display in the existing example. A display D11 is an area representing the total volume of ink, and the 100 g of the contained ink amount (A) is represented with an A portion 100% of the display D11. A display D12 is an area representing the consumed amount of ink, and the 40 g of the consumed ink amount (B) is represented as a ratio of 40% relative to the contained ink amount 100 g. A display D13 (shaded part) is the remaining amount of ink relative to the total volume of ink, and 100 g−40 g=60 g obtained subtracting the consumed ink amount (B) from the contained ink amount (A) is represented with a ratio 60% relative to the 100 g of the contained ink amount (A).

A display screen D2 is an exemplary display in the printing apparatus 10. A display D21 is an area representing the total volume of ink, and 100 g−40 g=60 g obtained subtracting the initial consumed ink amount (C) from the contained ink amount (A) is represented as 100% in the display D21 (A−C). A display D23 (shaded part) is the remaining amount relative to the total volume of ink, and 100 g−40 g=60 g obtained subtracting the consumed ink amount (B) from the contained ink amount (A) represents a ratio of 100% relative to the 60 g obtained by subtracting the initial consumed ink amount (C) from the contained ink amount (A).

In Case 1, on the display screen D1, the ink amount (B) consumed from the contained ink amount (A) in order to perform initial cleaning processing is displayed in a reduced state, despite being in a state before print processing by a user operation is performed. The user will view the display screen D1 on which ink has already been consumed, despite having installed an unused existing ink cartridge and having not yet performed print processing. The user could possibly feel distrustful of the existing apparatus and the existing ink cartridge with respect to the considerable amount of ink that has been consumed.

On the other hand, on the display screen D2, the printing apparatus 10 calculates the remaining ink amount on the basis of the ink amount that the user is able to use in print processing, given that the ink amount consumed by initial cleaning could not originally be used by the user in print processing. Such a display screen D2 is unlikely to make the user feel uneasy or distrustful in a state where an unused ink cartridge 60 has been installed and print processing has not yet been performed.

Case 2 represents a state where print processing has been performed with the ink cartridge installed from the state of Case 1. The contained ink amount (A) is 100 g and the initial consumed ink amount (C) is 40 g, the same as Case 1. The consumed ink amount (B) is 70 g, and the consumed ink amount has increased by 30 g from Case 1.

The display screen D3 is an exemplary display in the existing example. A display D31 is an area representing the total volume of ink, and the 100 g of the contained ink amount (A) is represented with an A portion 100% of the display D31. A display D32 is an area representing the consumed amount of ink, and the 70 g of the consumed ink amount (B) is represented as a ratio of 70% relative to the contained ink amount 100 g. A display D33 (shaded part) is the remaining amount of ink relative to the total volume of ink, and 100 g−70 g=30 g obtained by subtracting the consumed ink amount (B) from the contained ink amount (A) represents a ratio of 30% relative to the 100 g of the contained ink amount (A).

A display screen D4 is an exemplary display in the printing apparatus 10. A display D31 is an area representing the total volume of ink, and 100 g−40 g=60 g obtained by subtracting the initial consumed ink amount (C) from the contained ink amount (A) is shown as 100% in the display D31 (A−C). A display D42 is an area representing the consumed amount of ink, and 70 g−40 g=30 g obtained by subtracting the initial consumed ink amount (C) from the consumed ink amount (B) represents a ratio of 50% relative to 60 g obtained by subtracting the initial consumed ink amount (C) from the contained ink amount (A). A display D43 (shaded part) is the remaining amount relative to the total volume of ink, and 100 g−70 g=30 g obtained by subtracting the consumed ink amount (B) from the contained ink amount (A) represents a ratio of 50% relative to 60 g obtained by subtracting the initial consumed ink amount (C) from the contained ink amount of (A).

In Case 2, the ink weight consumed from Case 1 is 70 g−40 g=30 g. Also, in Case 2, the remaining ink weight is in a state where the same amount of 100 g−70 g=30 g remains in the ink cartridge. 30 g of ink has been used in order for the user to create a printed product printed himself or herself, enabling a printed product of the same weight to be printed with the remaining ink.

On the display screen D3 of the existing example, the remaining amount of ink is shown as 30%, and thus the user will mistakenly think that 70% of the ink was consumed in the printed product printed so far, and in the case where, for example, the user wants to further print a printed product of the same weight, he or she will think that the printed product cannot all be printed with a remaining ink amount of 30%. In such a situation, the user will think that the ink cartridge will run out, and purchases a new ink cartridge beforehand, resulting in the possibility of unnecessary expenditure on an ink cartridge that did not need to be used.

In the printing apparatus 10, the remaining ink amount is shown as 50%, and thus the user is able to intuitively recognize that 50% of the ink has been consumed in order to create the printed product that he or she has printed. For example, in the case of wanting to further print a printed product of the same weight, the user is able to recognize that there is sufficient ink if the remaining ink amount is 50%.

As described above, the following effects can be obtained with the printing system 1, the printing apparatus 10 and the ink cartridge 60 according to this embodiment.

The printing apparatus 10 stores the consumed amount of ink determined by the initial consumed ink amount determination unit 47 in the case where an unused ink cartridge 60 is installed as the initial consumed ink amount 75 in the storage device 70 of the nonvolatile memory of the ink cartridge 60. Information on the contained ink amount 71 and the consumed ink amount 73 is also stored in the storage device 70. The ink cartridge 60 also holds the information on the contained ink amount 71, the consumed ink amount 73 and the initial consumed ink amount 75 in a state of having been removed from the printing apparatus 10. Also, the ink amount consumed is written as the consumed ink amount 73 whenever an ink cartridge 60 is installed in the printing apparatus 10 and print processing is performed. The display-use remaining ink amount determination unit 49 calculates the display-use remaining ink amount (remaining ink amount (X)) using equation (1). The remaining ink amount (X) is a ratio with the difference between the contained ink amount (ink amount (A)) and the initial consumed ink amount (ink amount (C)) as the denominator, and the difference between the contained ink amount (ink amount (A)) and the consumed ink amount (ink amount (B)) as the numerator (equation (1)). The denominator is the maximum weight of ink that the user is able to use for print processing, since the initial consumed ink amount used by the initial cleaning processing that is mandatorily used by the printing apparatus 10 is subtracted. The numerator is the weight of ink obtained as a result of the ink amount used in print processing by the user being subtracted from the denominator, with the weight of ink in the denominator as the maximum. The remaining ink amount (X), which is the display-use remaining ink amount, is calculated to be a remaining ink amount of 100% (full) immediately after initial cleaning processing is executed, and is thereafter calculated as a ratio obtained by subtracting the consumed amount of ink that depends on the amount of print processing from full remaining ink amount, whenever print processing by the user is executed henceforth. Accordingly, the user is able to accurately grasp the remaining ink amount that decreases according to printing.

Also, the full remaining ink amount is displayed on the display unit 11 of the printing apparatus 10 as shown on the display screen D2 after an unused ink cartridge 60 is installed and initial cleaning processing is executed. Since a situation where a screen showing that a considerable amount of liquid has been consumed before the user has finished his or her own printed product is displayed, such as the display screen D11 of the existing example, no longer arises, a situation in which the user feels distrustful can be avoided.

Note that the invention is not limited to the above-mentioned embodiment, and various modifications, improvements and the like can be added to the above-mentioned embodiment. Variations are discussed below. Note that the same numerals are used for constituent parts that are the same as the above-mentioned embodiment, and redundant description is omitted.

Variation 1

Information Device

Figure 6:
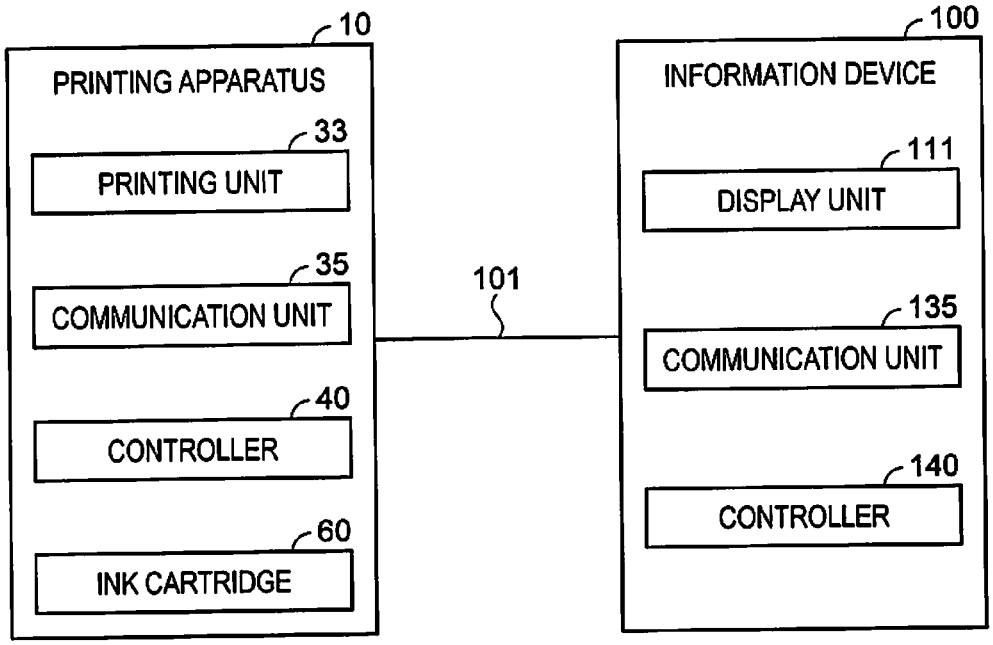
FIG. 6 is a block diagram showing a schematic configuration of an information device.

FIG. 6 is a block diagram showing a schematic configuration of an information device. An information device 100 is connected to the printing apparatus 10 in a data communicable manner by communication 101 indicating wired or wireless communication.

The printing apparatus 10 is provided with the printing unit 33, the communication unit 35 and the controller 40, and the ink cartridge 60 is installed therein.

The information device 100 is a typical smartphone, tablet terminal, PC (Personal Computer) or the like, and has a function of generating image data, document data and the like to be printed with the printing apparatus 10.

The information device 100 is constituted by a display unit 111 serving as a device display unit, a communication unit 135 serving as the device communication unit, and a controller 140 serving as an device controller, etc.

The display unit 111 is a display device such as a liquid crystal panel, and displays display screens generated by the controller 140, and the like. Note that the display unit 111 also corresponds to a notification unit, and a sound output unit or the like whose illustration is omitted may be further included in the notification unit.

The communication unit 135 establishes communication with the communication unit 35 of the printing apparatus 10 via the communication 101. The communication unit 135 is a USB adapter, a Bluetooth adapter, a wireless LAN adapter, or the like, and is configured to have a common communication protocol with the communication unit 35 of the printing apparatus 10.

The controller 140 is constituted by an operation processing unit such as a CPU and storage areas including volatile and nonvolatile memories such as ROM, RAM, NVRAM and EEPROM. The controller 140 generates image data, document data and the like for printing in the printing apparatus 10, and has a function of transmitting generated data and the like to the printing apparatus 10. Also, the controller 140 has a function of displaying the remaining ink amount of the printing apparatus 10 that is connected.

With the function of displaying the remaining ink amount of the controller 140, the communication unit 135 is controlled to receive the contained ink amount, the consumed ink amount and the initial consumed ink amount that were calculated in the controller 40 of the printing apparatus 10. With this function, a similar functional unit to the display-use remaining ink amount determination unit 49 of the printing apparatus 10 is provided, and the remaining ink amount (X) which is the display-use remaining ink amount is calculated by applying the received contained ink amount, consumed ink amount and initial consumed ink amount to equation (1) as the ink amount (A), the ink amount (B) and the ink amount (C). Thereafter, a display screen including an image indicating the ratio of the remaining ink amount (X) is generated and output to the display unit 11.

According to such information device 100, generated image data, document data and the like can be transmitted to the printing apparatus 10, and the display-use remaining ink amount of the ink cartridge 60 can be displayed before and after print processing. Similar effects to the above-mentioned embodiment can be obtained.

Variation 2

In the above-mentioned embodiment and variation, the printing system 1 as a liquid consumption system, the printing apparatus 10 as a liquid consumption apparatus, and the ink cartridge 60 as a liquid container were respectively illustrated, but the invention is not limited to these configurations, and the system may consist of an apparatus that consumes a liquid and a liquid container that is installable in the apparatus. For example, the liquid consumption apparatus may be a 3D printer that forms three-dimensional shapes by jetting a liquid solvent. The liquid container is a container that houses a liquid solvent, and the container need only be provided with a storage device in which information relating to the liquid solvent that corresponds to the contained ink amount 71, the consumed ink amount 73 and the initial consumed ink amount 75 is stored.

Also, for example, the liquid consumption apparatus may be an electric spraying apparatus that sprays paint. The liquid container is a container in which paint is housed in a pressurized state, and the container need only be provided with a storage device in which information relating to the paint is stored.

Even with such a configuration, similar effects to an above-mentioned embodiment and variation can be obtained.

Variation 3

In an above-mentioned embodiment and variation, the initial contained amount was stored in the storage device attached to the liquid container, but the invention is not limited to this configuration and may be configured as follows.

Information (e.g., information indicating sizes such as small, medium, large) relating to the size of the liquid container is stored in the storage device attached to the liquid container, and a table showing the size of the liquid container and the initial contained amount for each size are stored in the storage unit of the printing apparatus. The controller of the printing apparatus is able to read the information relating to the size of the liquid container from the storage device of the liquid container, and acquire the initial contained amount of the liquid container by referring to the table. In this case, "the information including the initial contained amount" is information relating to the size of the liquid container, and "acquiring the initial contained amount from the storage device" involves "acquiring the information relating to the size of the liquid container from storage device, and acquiring the initial contained amount with reference to the table."

Second Embodiment

A second embodiment will be described. Note that, in the second embodiment, the same reference signs are given to configuration that is similar to the first embodiment, and detailed description thereof is omitted.

Figure 7:
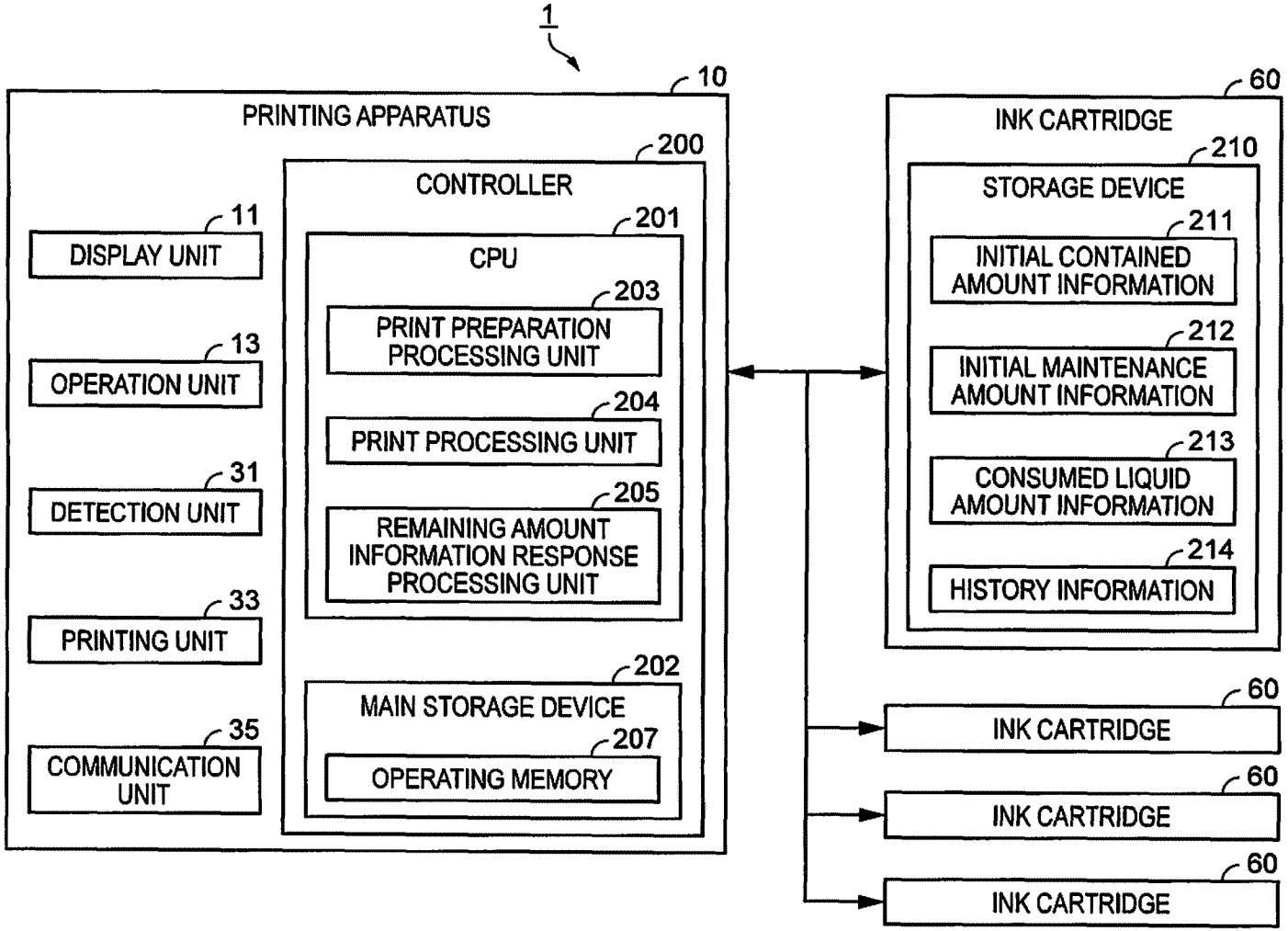
FIG. 7 is a block diagram showing a schematic configuration of a printing system in a second embodiment.

The printing system 1 in the second embodiment includes the printing apparatus 10 and the ink cartridges 60, as shown in FIG. 7. In the second embodiment, the printing apparatus 10 has a controller 200. The printing apparatus 10 in the second embodiment has a similar configuration to the printing apparatus 10 in the first embodiment, except for the controller 40 in the first embodiment being replaced by the controller 200. The controller 200 includes a CPU 201 and a main storage device 202. The CPU 201 includes a print preparation processing unit 203, a print processing unit 204, and a remaining amount information response processing unit 205. The print preparation processing unit 203 is a functional unit of the CPU 201 that executes print preparation processing which will be discussed later. The print processing unit 204 is a functional unit of the CPU 201 that performs print processing which will be discussed later. The remaining amount information response processing unit 205 is a functional unit of the CPU 201 that performs remaining amount information response processing which will be discussed later. Also, the main storage device 202 includes an operating memory 207. Various data, programs, and the like are expanded in the operating memory 207. RAM or the like, for example, can be employed as the operating memory 207.

Also, in the second embodiment, the ink cartridge 60 has a storage device 210. The ink cartridge 60 in the second embodiment has a similar configuration to the ink cartridge 60 in the first embodiment, except for the storage device 70 in the first embodiment being replaced by the storage device 210. The storage device 210 is capable of storing information relating to the ink cartridge 60. The information relating to the ink cartridge 60 includes information relating to the ink contained in the ink cartridge 60. Furthermore, initial contained amount information 211, initial maintenance amount information 212, consumed liquid amount information 213 and history information 214 are storable in the information relating to ink. In other words, the storage device 210 includes an area capable of storing the initial contained amount information 211, an area capable of storing the initial maintenance amount information 212, an area capable of storing the consumed liquid amount information 213, and an area capable of storing the history information 214.

The initial contained amount information 211 indicates the initial contained amount of ink in an unused ink cartridge 60 (hereinafter, given as contained ink amount (A)). Here, "unused" does not indicate that there is no history of the ink cartridge 60 having been installed in the printing apparatus 10. "Unused" refers to a state in which ink contained in the ink cartridge 60 has not been consumed by the printing apparatus 10. Consumption by the printing apparatus 10 includes consumption by printing and consumption by maintenance. Maintenance includes processing for cleaning the ejection head 21 and flushing processing.

The initial maintenance amount information 212 indicates the initial maintenance amount of ink consumed by the initial maintenance (hereinafter, given as the initial consumed ink amount (C)). Initial maintenance is maintenance that is executed first after an unused ink cartridge 60 is installed in the printing apparatus 10. The consumed liquid amount information 213 shows the consumed amount of ink consumed by the printing apparatus 10 out of the ink contained in an unused ink cartridge 60 (hereinafter, given as the consumed ink amount (B)). This consumed ink amount (B) includes the initial consumed ink amount (C). The history information 214 indicates existence/non-existence of a use history of the ink cartridge 60.

Figure 8:
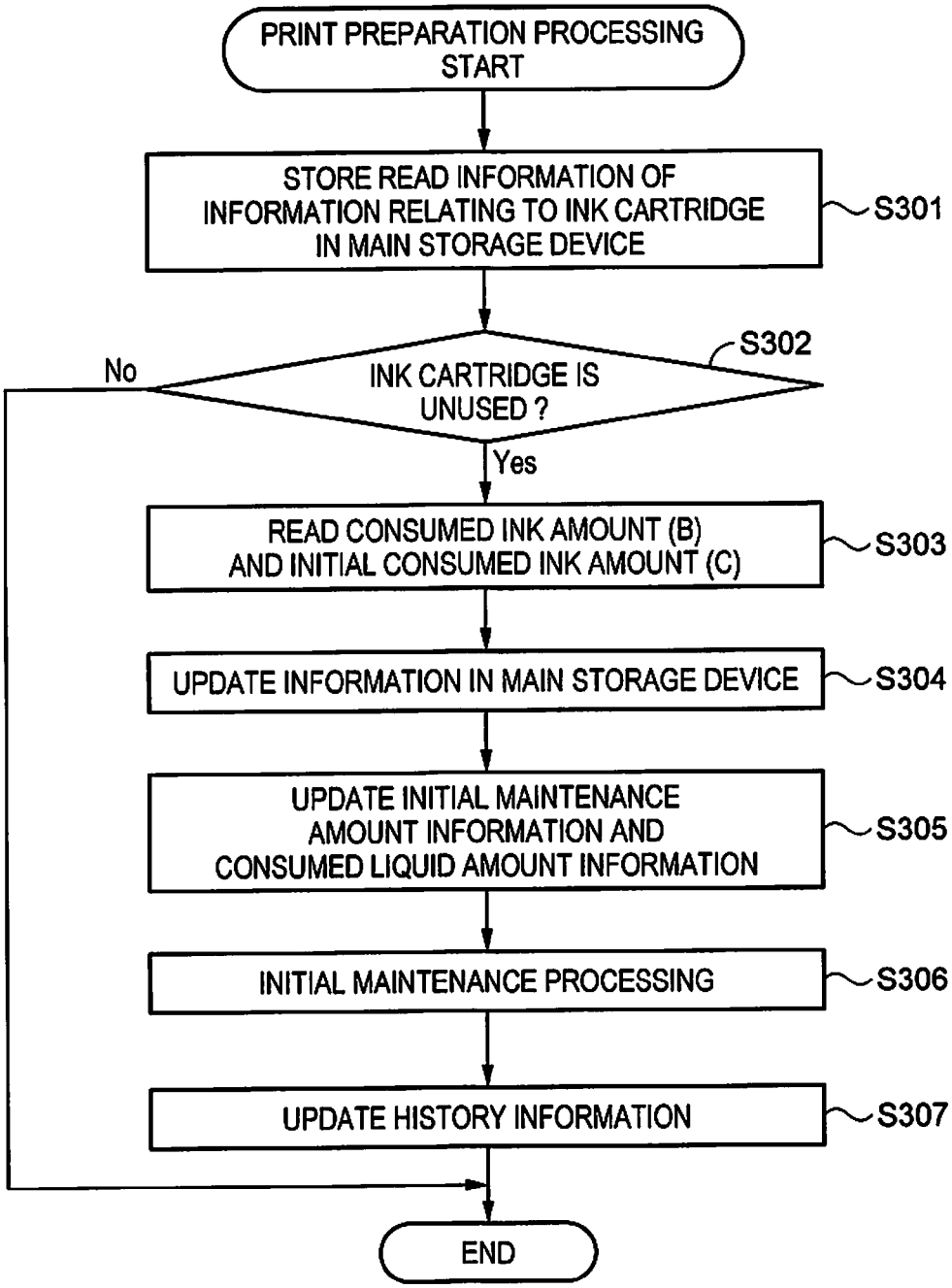
FIG. 8 is a flowchart showing print preparation processing in the second embodiment.

The print preparation processing in the printing system 1 will be described. In the printing system 1, when the input power supply changes from OFF to ON or when the ink cartridge 60 is replaced with another ink cartridge 60 in a state in which the input power supply is ON, the print preparation processing shown in FIG. 8 is implemented. The printing preparation processing is executed by the print preparation processing unit 203 of the CPU 201.

In print preparation processing, in step S301, information relating to the ink cartridge 60 is read from the storage device 210 of the ink cartridge 60 and the read information is stored in the main storage device 202. At this time, the CPU 201 accesses the storage device 210 of the ink cartridge 60, and reads the information relating to the ink cartridge 60. In this embodiment, the CPU 201 expands the information relating to the ink cartridge 60 read from the storage device 210 of the ink cartridge 60 in the operating memory 207 of the main storage device 202.

The information relating to the ink contained in the ink cartridge 60 and the history information 214 relating to the use history of the ink cartridge 60 are included in the information relating to the ink cartridge 60. The information relating to the ink contained in the ink cartridge 60 includes the initial contained amount information 211, the initial maintenance amount information 212 and the consumed liquid amount information 213.

The CPU 201 expands the contained ink amount (A) that is indicated by the read the initial contained amount information 211 in the main storage device 202. Similarly, the CPU 201 expands the initial consumed ink amount (C) that is indicated by the read initial maintenance amount information 212 in the main storage device 202, and expands the consumed ink amount (B) that is indicated by the read consumed liquid amount information 213 in the main storage device 202. Also, the CPU 201 expands existence/non-existence of a use history that is indicated by the read history information 214 in the main storage device 202.

Next, in step S302, it is determined whether the ink cartridge 60 is unused. At this time, the CPU 201 determines whether the ink cartridge 60 is unused, based on existence/non-existence of a use history of the ink cartridge 60. Note that, in the processing of step S302, a method that involves executing the processing of step S302 in a state of holding the data at the time that the CPU 201 read the history information 214 from the storage device 210 can be employed, for example. Also, as the processing of step S302, a method such as the CPU 201 reading data indicating existence/non-existence of a use history expanded in the main storage device 202 from the main storage device 202 and executing the processing of step S302 can be employed. As data indicating existence/non-existence of a use history, data "1" can show existence of a use history and data "0" can show non-existence of a use history, for example.

In step S302, when it is determined that the ink cartridge 60 is unused (Yes), the processing shifts to step S303, and when it is determined that the ink cartridge 60 is not unused (No), the processing ends.

In step S303, the consumed ink amount (B) and the initial consumed ink amount (C) to be updated are read from a database. The consumed ink amount (B) to be updated is the consumed ink amount (B) whose consumption is predicted in the subsequent processing (initial maintenance) of the step S306. Similarly, the initial consumed ink amount (C) to be updated is the initial consumed ink amount (C) whose consumption is predicted in the subsequent processing (initial maintenance processing) of the step S306. The consumed ink amount (B) and the initial consumed ink amount (C) to be updated are saved in the database (not illustrated) of the non-volatile storage area within the main storage device 202. The consumed ink amount (B) which depends on the temperature and humidity of the ambient environment of the printing apparatus 10 is tabularized in this database. In step S303, the CPU 201 reads the consumed ink amount (B) which depends on temperature data and humidity data detected by the detection unit 31 from the database. Note that because the processing of step S303 is processing that is executed on an unused ink cartridge 60, the consumed ink amount (B) and the initial consumed ink amount (C) that are read at step S303 are the same as each other.

Next, in step S304, the information stored in the main storage device 202 is updated. At this time, the CPU 201 updates the consumed ink amount (B) and the initial consumed ink amount (C) stored in the main storage device 202 in step S301 to the consumed ink amount (B) and the initial consumed ink amount (C) read at step S303.

Next, in step S305, the initial maintenance amount information 212 and the consumed liquid amount information 213 that are saved in the storage device 210 of the ink cartridge 60 are updated. At this time, the CPU 201 updates the consumed liquid amount information 213 that is saved in the storage device 210 of the ink cartridge 60 to the consumed liquid amount information 213 indicating the consumed ink amount (B) read at step S303. Also, the CPU 201 updates the initial maintenance amount information 212 that is saved in the storage device 210 of the ink cartridge 60 to the initial maintenance amount information 212 indicating the initial consumed ink amount (C) read at step S303.

Next, in step S306, the initial maintenance processing is implemented. Initial maintenance is thereby executed.

Next, in step S307, the history information 214 that is saved in the storage device 210 of the ink cartridge 60 is updated, after which the print preparation processing is ended. At this time, the CPU 201 updates the history information 214 indicating non-existence of a use history of the ink cartridge 60 to history information 214 indicating existence of a use history. This can be realized by, for example, updating data "0" indicating non-existence of a use history of the ink cartridge 60 to data "1" indicating existence of a use history. Note that, in the above print preparation processing, the order of the processing of steps S304 to S307 is not limited to this order, and an arbitrary order can be employed. That is, the processing of steps S304 to S307 may be arranged in any order.

Figure 9:
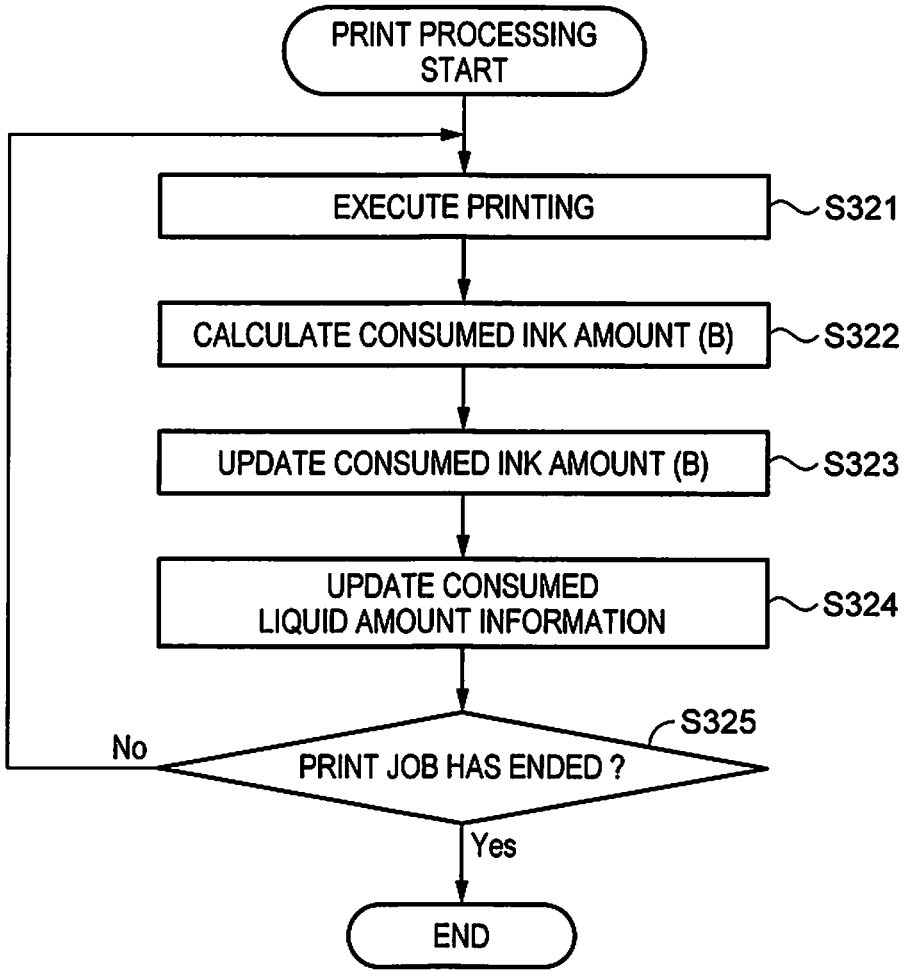
FIG. 9 is a flowchart showing print processing in the second embodiment.

After ending the print preparation processing, the processing stands by until there is another request. At this time, upon receiving a request for print processing, which is one of the other requests, the print processing shown in FIG. 9 is implemented. The print processing is executed by the CPU 201. The request of print processing is effected by receiving a print job from a PC or the like via the communication unit 35 (FIG. 7), for example.

Upon the print processing being started, printing based on the print job is executed in step S321. At this time, the CPU 201 outputs an command instructing execution of printing based on the print job to the printing unit 33 (FIG. 7). Based on the command instructing execution of printing, the printing unit 33 controls the drive of a conveyance roller that conveys the paper P, the drive of the carriage 20, and the drive of the ejection head 21. Printing based on a print job is thereby performed.

In the printing of step S321, the print data corresponding to one print job may be divided into a plurality of print data, and the processing may shift to the following step S322 every time printing of the divided print data is ended, or the processing may shift to the following step S322 after completing printing of all of the print data corresponding to one print job. Also, in the printing of step S321, the processing may shift to the following step S322 every predetermined period of time in the printing process of print data corresponding to one print job. That is, in the printing of step S321, both a method that completes one print job in one iteration of the processing of step S321 and a method that completes one print job in a plurality of iterations the processing of step S321 can be employed.

Next, in step S322, the consumed ink amount (B) is calculated. The consumed ink amount (B) is calculated by calculating the ink amount that is ejected from the ejection head 21, similarly to the first embodiment. The consumed ink amount (B) also includes the ink amount that is ejected from the ejection head 21 at the time of maintenance that is implemented when needed, apart from the ink amount that is ejected from the ejection head 21 at the time of printing to the paper P. The ink ejected from the ejection head 21 is ejected as ink droplets from the nozzles. At this time, the size (large, medium, small, etc.) of the ink droplets that are ejected, the number of ejections and the like are counted. Furthermore, the weight of the ejected ink is calculated as the consumed ink amount (B), based on the temperature detected by the detection unit 31, with consideration for the expansion of ink and the like.

Next, in step S323, the consumed ink amount (B) that is stored in the main storage device 202 is updated. At this time, the CPU 201 adds the consumed ink amount (B) calculated in step S322 to the consumed ink amount (B) that is stored in the main storage device 202, and updates to a new consumed ink amount (B). As a result of this processing of step S323, the cumulative total of consumed ink amounts (B) in one ink cartridge 60 is calculated.

Next, in step S324, the consumed liquid amount information 213 that is saved in the storage device 210 of the ink cartridge 60 is updated. At this time, the CPU 201 updates the consumed liquid amount information 213 that is saved in the storage device 210 of the ink cartridge 60 to the consumed liquid amount information 213 indicating a new consumed ink amount (B) updated at step S323. As a result of this processing of step S324, the cumulative total of consumed ink amounts (B) in this ink cartridge 60 is updated in the storage device 210 of the ink cartridge 60.

Next, in step S325, it is determined whether the print job has ended. At this time, the print processing is ended when it is determined that the print job has ended (Yes), and the processing shifts to the processing of step S321 when it is determined that the print job has not ended (No).

Figure 10:
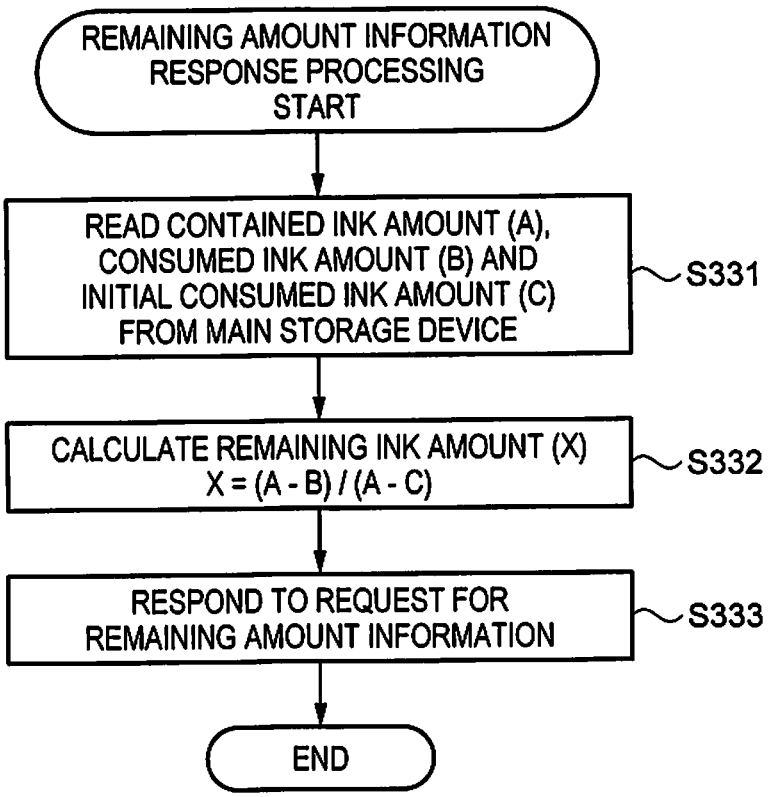
FIG. 10 is a flowchart showing remaining amount information response processing in the second embodiment.

When the print processing is ended, the processing stands by until there is another request. At this time, upon receiving a request for remaining amount information, which is one of the other requests, the remaining amount information response processing shown in FIG. 10 is implemented. Remaining amount information is information indicating the remaining ink amount that is left in the ink cartridge 60. Remaining amount information response processing is processing that involves calculating the remaining ink amount, based on the request for remaining amount information, and returning (responding with) the calculated remaining ink amount. The remaining amount information response processing is executed by the remaining amount information response processing unit 205 of the CPU 201.

The request for remaining amount information includes, for example, a request for remaining amount information that is received from a PC or the like via the communication unit 35 (FIG. 7) and a request that is received when a user requests display of the remaining ink amount on the display unit 11 via the operation unit 13. The remaining amount information response processing is executed by the CPU 201. The request for remaining amount information response processing is effected by receiving a request for remaining amount information from a PC or the like via the communication unit 35 (FIG. 7), for example. Also, for example, in the case where the request for remaining amount information is a request by the user for display of the remaining ink amount on the display unit 11, the request for the remaining amount information response processing is effected by the user requesting display of the remaining ink amount on the display unit 11 via the operation unit 13.

First, in step S331, the contained ink amount (A), the consumed ink amount (B) and the initial consumed ink amount (C) are read from the main storage device 202.

Next, in step S332, the remaining ink amount (X) is calculated. The remaining ink amount (X) is similar to the remaining ink amount (X) described in the first embodiment, and thus detailed description thereof is omitted. the remaining ink amount (X) is calculated by the aforementioned equation (1).

Next, in step S333, the request for remaining amount information is responded to. As described above, the request for remaining amount information includes a request for remaining amount information from a PC or the like and a request by the user for display of the remaining ink amount. The processing of step S333 is processing for responding to these requests for remaining amount information. Responding to a request for the remaining amount information thus also includes performing display that is based on the remaining amount information according to a request for display of the remaining ink amount.

For example, in the case where the request for remaining amount information is a request for remaining amount information from a PC or the like, the CPU 201 transmits (responds with) remaining amount information indicating the remaining ink amount (X) calculated at step S332 to the PC or the like in step S333. Also, in the case where, for example, the request for remaining amount information is a request by the user for display of remaining ink amount on the display unit 11, the CPU 201 displays (responds with) the remaining ink amount on the display unit 11 in step S333, based on the remaining amount information indicating the remaining ink amount (X) calculated at step S332. Note that the response to a request for remaining amount information is not limited to returning remaining amount information to an information device such as a PC, or performing the display that is based on remaining amount information, as long as the response is in accordance with the contents of the request. The various responses associated with remaining amount information indicating the calculated remaining ink amount (X) are included as responses to requests for remaining amount information.

Similar effects to the first embodiment are also obtained in the above-mentioned second embodiment. Furthermore, in the second embodiment, the number of times that the storage device 210 of the ink cartridge 60 is accessed in order to read the contained ink amount (A), the consumed ink amount (B) and the initial consumed ink amount (C) can be reduced as compared with the first embodiment, enabling the time taken by processing to be shortened.

Also, in the second embodiment, the consumed ink amount (B) that depends on the temperature and humidity of the ambient environment of the printing apparatus 10 is tabularized in the database within the main storage device 202. In the print preparation processing, the CPU 201 then updates the initial consumed ink amount (C) to the consumed ink amount (B) read from the database within the main storage device 202. That is, in the second embodiment, the initial consumed ink amount (C) is updated to a consumed amount that is predicted, rather than counting the ink amount that is consumed in initial maintenance. The time taken by processing can thus be shortened, compared with the method of counting the ink amount that is consumed in initial maintenance.

Third Embodiment

A third embodiment will be described. The third embodiment has a similar configuration to the second embodiment, except for part of print preparation processing (FIG. 8) in the second embodiment differing. In the third embodiment, the same reference signs as the second embodiment are thus given to configuration that is similar to the second embodiment, and detailed description thereof is omitted. In the print preparation processing in the second embodiment, a method that involves reading the consumed ink amount (B) and the initial consumed ink amount (C) to be updated from a database is employed. In contrast, in the third embodiment, a method that involves calculating the consumed ink amount (B) and the initial consumed ink amount (C) to be updated is employed.

Figure 11:
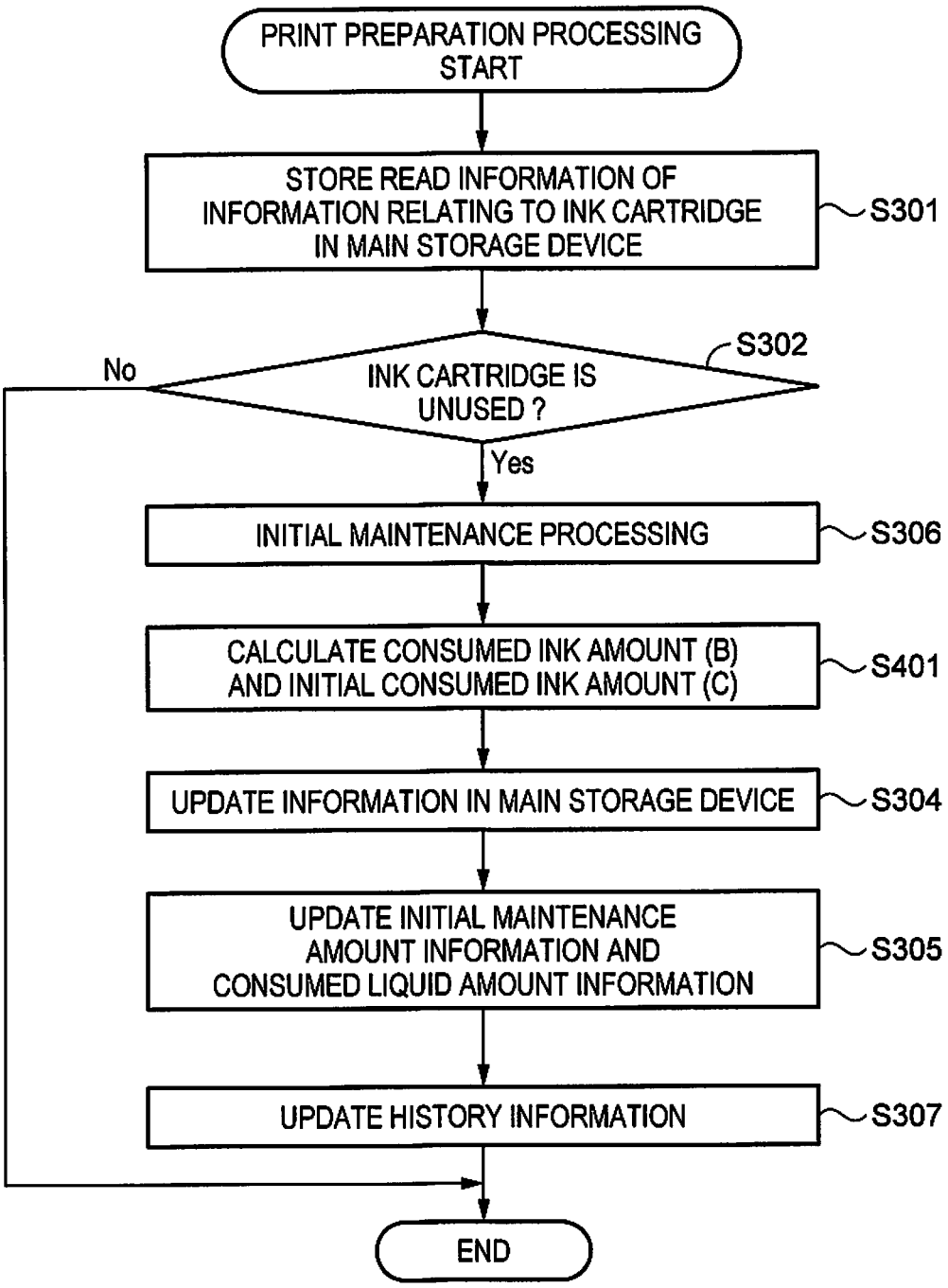
FIG. 11 is a flowchart showing print preparation processing in a third embodiment.

The print preparation processing in the third embodiment will be described. In the print preparation processing in the third embodiment, the same reference signs as the second embodiment are given to processing that is similar to the second embodiment, and detailed description thereof is omitted. In the print preparation processing in the third embodiment, the processing of step S306 is located between the processing of step S302, and the processing of step S304, and the processing of step S401 is provided between the processing of step S306 and the processing of step S304, as shown in FIG. 11. Note that, in the print preparation processing in the third embodiment, the processing of step S303 (FIG. 8) in the second embodiment is omitted.

In step S401, the consumed ink amount (B) and the initial consumed ink amount (C) to be updated are calculated. The consumed ink amount (B) and the initial consumed ink amount (C) to be updated are calculated by calculating the ink amount that is ejected from the ejection head 21, similarly to the first embodiment and the second embodiment. In step S401, the ink amount that is ejected from the ejection head 21 in the initial maintenance processing is calculated. At this time, factors such as the size (large, medium, small, etc.) of the ink droplets that are ejected and the number of ejections are counted. Furthermore, the weight of ejected ink is calculated as the consumed ink amount (B) and the initial consumed ink amount (C) to be updated, based on the temperature detected by the detection unit 31, with consideration for the expansion of ink and the like.

Similar effects to the first embodiment are also obtained in the above-mentioned third embodiment.

Fourth Embodiment

A fourth embodiment will be described. The fourth embodiment has a similar configuration to the second embodiment, except for part of the print preparation processing (FIG. 8) in the second embodiment differing. In the fourth embodiment, the same reference signs are thus given to configuration that is similar to the second embodiment, and detailed description thereof is omitted.

Figure 12:
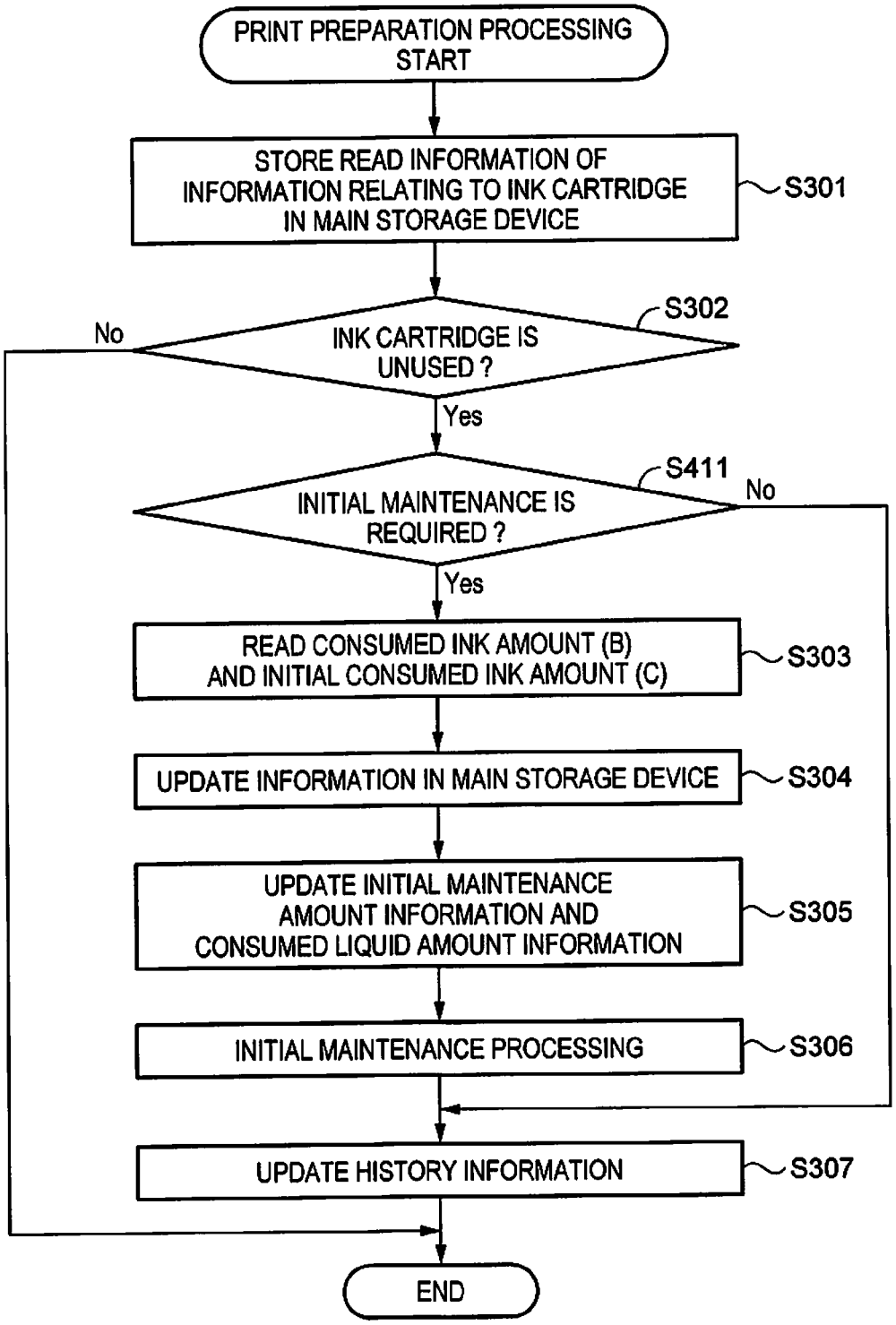
FIG. 12 is a flowchart showing print preparation processing in a fourth embodiment.

The print preparation processing in the fourth embodiment will be described. In the print preparation processing in the fourth embodiment, the same reference signs as the second embodiment are given to processing that is similar to the second embodiment, and detailed description thereof is omitted. In the print preparation processing in the fourth embodiment, the processing of step S411 is provided between the processing of step S302 and the processing of step S303, as shown in FIG. 12.

In step S411, it is determined whether initial maintenance is required, and when it is determined that initial maintenance processing is required (Yes), the processing shifts to step S303, and when it is determined that initial maintenance processing is not required (No), the processing shifts to step S307. At this time, when it is determined that that initial maintenance processing is not required (No), the consumed ink amount (B) and the initial consumed ink amount (C) that are stored in the main storage device 202 and the initial maintenance amount information 212 that is saved in the storage device 210 of the ink cartridge 60 are maintained. That is, the CPU 201 maintains the initial maintenance amount in the main storage device 202 and the initial maintenance amount information 212 in the storage device 210, when it is determined that initial maintenance processing is not required (No).

Similar effects to the first embodiment and the second embodiment are also obtained in the fourth embodiment. It is envisioned that initial maintenance can be omitted, depending on the model of the printing apparatus 10 and the ink cartridge 60. In this embodiment, such a case can be handled by the processing of step S411.

Fifth Embodiment

A fifth embodiment will be described. The fifth embodiment has a similar configuration to the third embodiment, except for part of the print preparation processing (FIG. 11) in the third embodiment differing. In the fifth embodiment, the same reference signs as the third embodiment are thus given to configuration that is similar to the third embodiment, and detailed description thereof is omitted.

Figure 13:
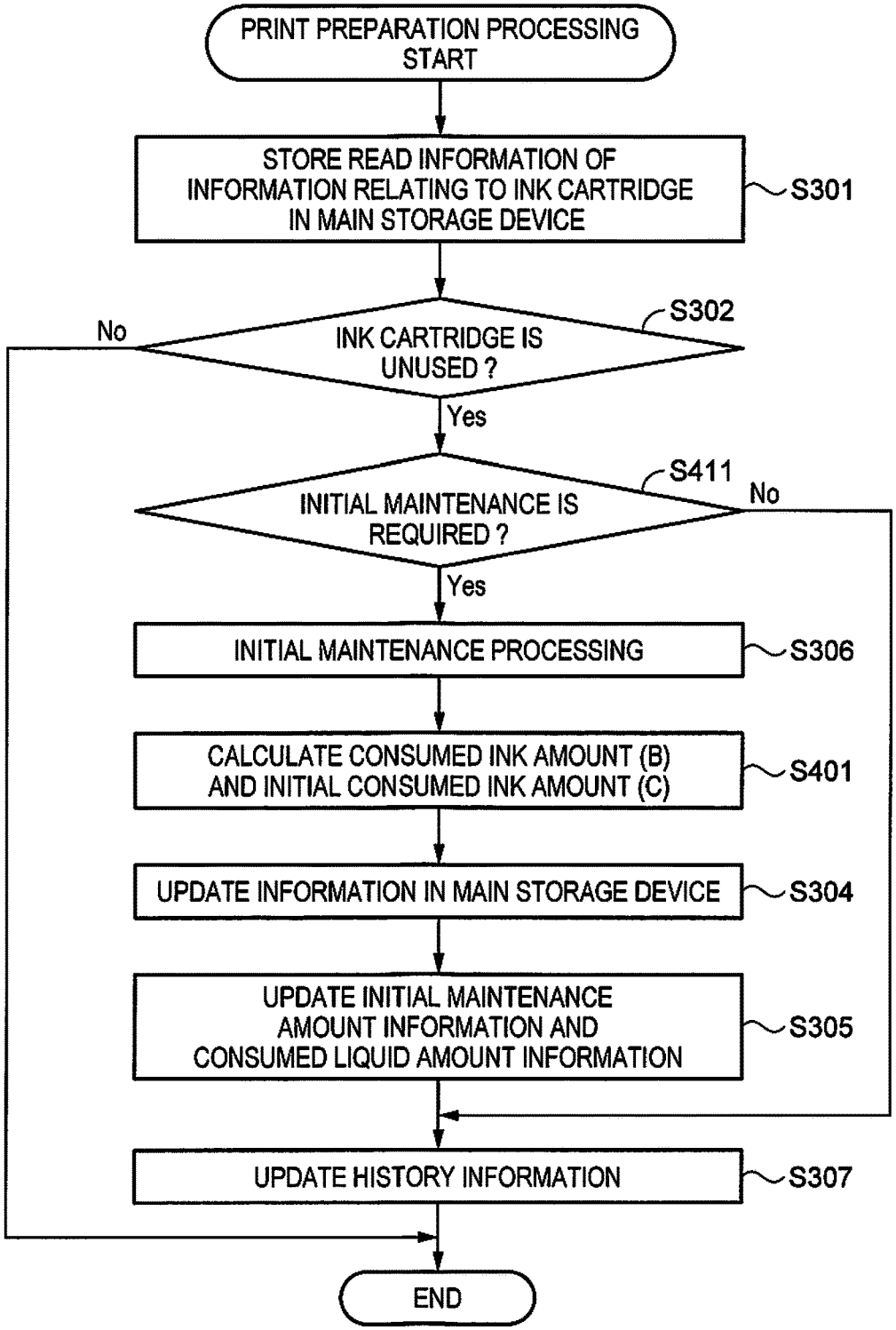
FIG. 13 is a flowchart showing print preparation processing in a fifth embodiment.

The print preparation processing in the fifth embodiment will be described. In the print preparation processing in the fifth embodiment, the same reference signs as the third embodiment and the fourth embodiment are given to processing that is similar to the third embodiment and the fourth embodiment, and detailed description thereof is omitted. In the print preparation processing in the fifth embodiment, the processing of step S411 is provided between the processing of step S302 and the processing of step S306, as shown in FIG. 13. The processing of step S411 is similar to the fourth embodiment.

In step S411, it is determined whether initial maintenance is required, and when it is determined that initial maintenance processing is required (Yes), the processing shifts to step S306, and when it is determined that initial maintenance processing is not required (No), the processing shifts to step S307. Similar effects to the first embodiment and the third embodiment are also obtained in the fifth embodiment.

Note that the above variations 1 to 3 can also be applied to each of the second to fifth embodiments.

Also, in each of above-mentioned embodiments, the initial contained amount (contained ink amount (A)), the initial maintenance amount (initial consumed ink amount (C)), and the consumed amount of ink (consumed ink amount (B)) that are stored in the main storage device 202 are stored as weight information of ink. In the storage device 210 of the ink cartridge 60, the initial contained amount information 211, the initial maintenance amount information 212, and the consumed liquid amount information 213 that respectively correspond to the initial contained amount, the initial maintenance amount and the consumed amount of ink that are stored in the main storage device 202 may be weight information similarly the storage in the main storage device 202, or may be ratio information relative to the initial contained amount.

What is claimed is:

1. A liquid consumption apparatus configured to have detachably installed therein a liquid container that contains a liquid, the liquid container having attached thereto a storage device configured to store information including an initial contained amount which is an amount of liquid contained in the liquid container that is unused, the liquid consumption apparatus comprising:

an ejection unit configured to eject a liquid supplied from the liquid container;

a first consumed amount calculation unit configured to calculate a first consumed amount which is a consumed amount of liquid that is ejected from the ejection unit;

an initial maintenance execution unit configured to execute initial maintenance of the ejection unit, the initial maintenance being performed in a case where the liquid container that is unused is installed and the initial maintenance excluding subsequent maintenance;

a second consumed amount determination unit configured to determine a second consumed amount which is a consumed amount of liquid consumed by the initial maintenance;

a write processing unit configured to write at least the first consumed amount and the second consumed amount to the storage device;

an acquisition unit configured to acquire the initial contained amount, the first consumed amount and the second consumed amount from the storage device; and a notification-use information determination unit configured to determine notification-use information which is information for notification, based on the initial contained amount, the first consumed amount and the second consumed amount that were acquired, wherein the notification-use information determination unit calculates a ratio of a difference between the initial contained amount and the first consumed amount relative to a difference between the initial contained amount and the second consumed amount as the notification-use information.

2. The liquid consumption apparatus according to claim 1, further comprising:

a detection unit configured to detect environmental information including an ambient temperature of the ejection unit, wherein the first consumed amount calculation unit and the second consumed amount determination unit calculate the first consumed amount and the second consumed amount with reference to the detected environmental information.

3. The liquid consumption apparatus according to claim 1 further comprising:

a display unit wherein the display unit displays the notification-use information.

4. The liquid consumption apparatus according to claim 1 further comprising:

a transmission unit configured to transmit information to an information device provided with a notification unit, wherein the transmission unit transmits the notification-use information to the information device.

* * * * *